US008092105B2

(12) United States Patent
Nakatani

(10) Patent No.: US 8,092,105 B2
(45) Date of Patent: Jan. 10, 2012

(54) IMAGE GENERATING APPARATUS

(75) Inventor: Masaki Nakatani, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 975 days.

(21) Appl. No.: 11/971,771

(22) Filed: Jan. 9, 2008

(65) Prior Publication Data

US 2008/0213025 A1 Sep. 4, 2008

(30) Foreign Application Priority Data

Jan. 10, 2007 (JP) ..... 2007-2326

(51) Int. Cl.
*B41J 35/04* (2006.01)

(52) U.S. Cl. ..... 400/248; 400/247

(58) Field of Classification Search ..... 400/248
See application file for complete search history.

(56) References Cited

U.S. PATENT DOCUMENTS

| | | | | |
|---|---|---|---|---|
| 5,709,488 | A * | 1/1998 | Imai et al. | 400/234 |
| 5,746,520 | A * | 5/1998 | Kohira | 400/120.01 |
| 5,936,653 | A * | 8/1999 | Yamaguchi et al. | 347/216 |
| 6,046,757 | A * | 4/2000 | Kanai | 347/197 |
| 7,256,806 | B2 * | 8/2007 | Nakatani | 347/197 |
| 7,414,642 | B2 | 8/2008 | Abe et al. | |
| 7,453,482 | B2 | 11/2008 | Nakatani | |
| 2006/0082636 | A1 * | 4/2006 | Maruyama | 347/197 |
| 2006/0216096 | A1 * | 9/2006 | Sawai | 400/120.16 |

FOREIGN PATENT DOCUMENTS

| | | | |
|---|---|---|---|
| JP | 3-116950 | U | 12/1991 |
| JP | 7-156487 | A | 6/1995 |
| JP | 2001-63868 | A | 3/2001 |
| JP | 2005-205842 | A | 8/2005 |
| JP | 3832097 | B2 | 7/2006 |
| JP | 2006-240091 | A | 9/2006 |
| JP | 2006-347124 | A | 12/2006 |

OTHER PUBLICATIONS

Japanese Office Action dated Nov. 25, 2008 with English translation (four (4) pages).

* cited by examiner

*Primary Examiner* — Anthony Nguyen
(74) *Attorney, Agent, or Firm* — Crowell & Moring LLP

(57) ABSTRACT

An image generating apparatus capable of properly feeding papers in the body thereof and reliably suppressing wrinkling easily caused on cross-directional ends of an ink sheet is obtained. This image generating apparatus includes a print head, including a print portion pressing an ink sheet, capable of printing an image on a paper, a paper guide member guiding a transport direction for the paper when feeding the paper and an ink sheet guide member, having a central portion convexed toward a take-up direction for the ink sheet with respect to the print head in plan view, for guiding transportation of the ink sheet in printing, while a region of the paper guide member corresponding to a cross-directional end of the ink sheet integrally includes an ink sheet contact portion so shaped as to apply tension to the cross-directional end of the ink sheet.

15 Claims, 11 Drawing Sheets

IMAGE GENERATING APPARATUS

BACKGROUND OF THE INVENTION

1. Field of the Invention

The present invention relates to an image generating apparatus, and more particularly, it relates to an image generating apparatus comprising a print head, including a print portion pressing an ink sheet, capable of printing images on papers.

2. Description of the Background Art

An image generating apparatus comprising a print head, including a print portion pressing an ink sheet, capable of printing images on papers is known in general, as disclosed in each of Japanese Patent Laying-Open Nos. 2001-63868 and 7-156487 (1995), Japanese Patent No. 3832097 and Japanese Patent Laying-Open No. 2006-240091, for example.

The aforementioned Japanese Patent Laying-Open No. 2001-63868 discloses a thermal transfer recording apparatus (image generating apparatus) comprising a thermal head (print head), a protective cover provided on a first end of the thermal head for protecting a drive portion driving a heating element provided on the lower portion of the thermal head and guiding transportation of an ink sheet along the lower portion of the thermal head and a sheet guide provided on a second end of the thermal head for guiding transportation of the ink sheet passing through the heating element provided on the lower portion of the thermal head. In the thermal transfer recording apparatus (image generating apparatus) described in Japanese Patent Laying-Open No. 2001-63868, a contact surface of the protective cover coming into contact with the ink sheet in printing is enabled to come into contact with the ink sheet for expanding the central portion of the ink sheet more than both cross-sectional ends thereof, thereby transporting the ink sheet while applying stronger tension to the central portion thereof as compared with both cross-directional ends.

The aforementioned Japanese Patent Laying-Open No. 7-156487 discloses a thermal transfer recording apparatus (image generating apparatus) comprising a thermal head (print head) and a guide bar provided on the rear end of the thermal head for controlling the transport direction for an ink donor film (ink sheet) passing through a heating resistor provided on the lower portion of the thermal head. In the thermal transfer recording apparatus (image generating apparatus) described in Japanese Patent Laying-Open No. 7-156487, a contact surface of the guide bar coming into contact with the ink donor film in printing is bent with downward inclination from the cross-directional central portion toward both ends of the guide bar, so that the guide bar transports the ink donor film while bending both ends thereof in the same direction as the contact surface thereof.

The aforementioned Japanese Patent No. 3832097 discloses a thermal transfer printer (image generating apparatus) comprising a substrate provided with a heating element having a prescribed printing width on the lower surface thereof and a thermal head (print head) including a first guide portion integrally formed on a support plate mounted with the substrate for guiding transportation of a thermal transfer ribbon (ink sheet) and a second guide portion mounted on the lower surface of the substrate for guiding transportation of the thermal transfer ribbon. In the thermal transfer printer (image generating apparatus) described in Japanese Patent No. 3832097, the first guide member is so formed as to vary the sectional shape thereof along the cross direction of the thermal transfer ribbon, to be capable of transporting the thermal transfer ribbon while warping the same in the cross direction. The second guide portion is so formed as to have a sectional shape of a prescribed thickness along the cross direction of the thermal transfer ribbon, to be capable of controlling the position of the thermal transfer ribbon immediately before passage through the heating element.

The aforementioned Japanese Patent Laying-Open No. 2006-240091 discloses a thermal transfer printer (image generating apparatus) comprising a line thermal head (print head), a ribbon guide provided on the line thermal head for guiding transportation of an ink ribbon (ink sheet) along the lower portion of the line thermal head and a separation plate separating the ink ribbon from a recording paper after printing. In the thermal transfer printer (image generating apparatus) described in Japanese Patent Laying-Open No. 2006-240091, a ribbon sliding contact portion of the separation plate uniformly comes into contact with the ink ribbon along the cross direction after printing, so that the ink ribbon adhering to the recording paper in printing can be separated from the recording paper. Further, the ribbon sliding contact portion of the separation plate is provided with a plurality of strip-shaped grooves (ribbon guide portions), to be capable of preventing the ink ribbon from meandering.

However, the aforementioned Japanese Patent Laying-Open No. 2001-63868 proposing the thermal transfer recording apparatus (image generating apparatus) neither discloses nor suggests a member for controlling the transport direction for a recording paper (paper) when the recording paper is fed into the body of the apparatus. If the recording paper (paper) is fed into the body of the apparatus with unnecessary warpage, therefore, the recording paper (paper) may not be properly fed due to interference with any of the internal components of the apparatus. Further, Japanese Patent Laying-Open No. 2001-63868 proposing the thermal transfer recording apparatus neither definitely describes nor suggests the relation between the cross-directional size of the protective cover and the width of the ink sheet. If the cross-directional size of the protective cover is smaller than the width of the ink sheet, therefore, the protective cover comes into contact with only a portion around the cross-directional central portion of the ink sheet, whereby the protective cover can conceivably not reliably apply tension to easily wrinkled cross-directional ends of the ink sheet. Therefore, wrinkling easily caused on the cross-directional ends of the ink sheet cannot be reliably suppressed, in particular.

The aforementioned Japanese Patent Laying-Open No. 7-156487 proposing the thermal transfer recording apparatus (image generating apparatus) neither discloses nor suggests a member controlling the transport direction for a recording paper when the recording paper is fed into the body of the apparatus. If the recording paper is fed into the body of the apparatus with unnecessary warpage, therefore, the recording paper may not be properly fed due to interference with any of the internal components of the apparatus. Further, Japanese Patent Laying-Open No. 7-156487 proposing the thermal transfer recording apparatus neither definitely describes nor suggests the relation between the cross-directional length of the guide bar and the width of the ink donor film. If the cross-directional length of the guide bar is smaller than the width of the ink donor film, therefore, the guide bar comes into contact with only a portion around the cross-directional central portion of the ink donor film, whereby the guide bar can conceivably not reliably apply tension to easily wrinkled cross-directional ends of the ink donor. Therefore, wrinkling easily caused on the cross-directional ends of the ink donor film (ink sheet) cannot be reliably suppressed, in particular.

The aforementioned Japanese Patent No. 3832097 proposing the thermal transfer printer (image generating apparatus) neither discloses nor suggests a member controlling a supply path for a recording medium (paper) when the recording medium is supplied into the body of the printer. If the recording medium (paper) is fed into the body of the printer with unnecessary warpage, therefore, the recording medium (paper) may not be properly fed due to interference with any of the internal components of the printer. In the thermal transfer printer described in Japanese Patent No. 3832097, further, the second guide portion is conceivably so formed as to have a uniformly thick sectional shape along the cross direction of the thermal transfer ribbon, whereby the thermal transfer ribbon is transported while receiving uniform pressing force from the second guide portion on the cross-directional central portion and the cross-directional ends thereof. In this case, no tension is caused between the central and the ends of the thermal transfer ribbon in the cross direction thereof, whereby wrinkling easily caused on the cross-directional ends of the thermal transfer ribbon (ink sheet) cannot be suppressed, in particular.

The aforementioned Japanese Patent Laying-Open No. 2006-240091 proposing the thermal transfer printer (image generating apparatus) neither discloses nor suggests a member controlling the transport direction for the recording paper when the recording paper is fed into the body of the printer. If the recording paper is fed into the body of the printer with unnecessary warpage, therefore, the recording paper may not be properly fed due to interference with any of the internal components of the printer. In the thermal transfer printer described in Japanese Patent Laying-Open No. 2006-240091, further, the outer shape of the ribbon sliding contact portion of the separation plate is conceivably uniformized along the cross direction of the ink ribbon, whereby the ink ribbon is transported while receiving uniform pressing force from the ribbon sliding contact portion of the separation plate on the cross-directional central portion and the cross-directional ends thereof. In this case, no tension is caused between the central portion and the ends of the ink ribbon in the cross direction thereof, whereby wrinkling easily caused on the cross-directional ends of the ink ribbon (ink sheet) cannot be suppressed, in particular.

SUMMARY OF THE INVENTION

The present invention has been proposed in order to solve the aforementioned problems, and an object of the present invention is to provide an image generating apparatus capable of properly feeding papers in the body thereof and reliably suppressing wrinkling easily caused on cross-directional ends of an ink sheet.

An image generating apparatus according to an aspect of the present invention comprises a print head, including a print portion pressing an ink sheet, capable of printing an image on a paper, a paper guide member guiding a transport direction for the paper when feeding the paper and an ink sheet guide member, having a central portion convexed toward a take-up direction for the ink sheet with respect to the print head in plan view, for guiding transportation of the ink sheet in printing, while a region of the paper guide member corresponding to a cross-directional end of the ink sheet integrally includes an ink sheet contact portion so shaped as to apply tension to the cross-directional end of the ink sheet.

As hereinabove described, the image generating apparatus according to the aspect of the present invention comprises the paper guide member guiding the transport direction for the paper when feeding the paper so that the paper guide member guides the transport direction for the paper even if the paper is fed into the apparatus with unnecessary warpage, thereby properly feeding the paper. The image generating apparatus further comprises the ink sheet guide member having the central portion convexed toward the take-up direction for the ink sheet with respect to the print head in plan view for guiding transportation of the ink sheet in printing so that the ink sheet guide member guides transportation of the ink sheet on anteroposteriorly different positions with respect to the take-up direction for the ink sheet on a cross-directional central portion and the cross-directional end of the ink sheet. In other words, transportation of the ink sheet is guided successively from the cross-directional end toward the central portion of the ink sheet, whereby wrinkling easily caused on the end of the ink sheet can be preferentially suppressed. Further, the region of the paper guide member corresponding to the cross-directional end of the ink sheet integrally includes the ink sheet contact portion so shaped as to apply tension to the cross-directional end of the ink sheet so that the cross-directional end of the ink sheet is transported in a state stretched by the ink sheet contact portion of the paper guide member, whereby wrinkling easily caused on the cross-directional end of the ink sheet can be more reliably suppressed also by the ink sheet contact portion of the paper guide member, in addition to the aforementioned effect of suppressing wrinkling by the ink sheet guide member.

In the image generating apparatus according to the aforementioned aspect, the paper guide member is preferably so formed as to rotate with the print head rotatable between a nonprinting position and a printing position for the paper, and the paper guide member is preferably so formed as to guide the transport direction for the paper when the print head rotates to the printing position. According to this structure, the paper guide member can rotate to a position for guiding the paper through the rotation of the print head in printing, thereby reliably guiding the transport direction for the paper.

In the image generating apparatus according to the aforementioned aspect, the ink sheet contact portion of the paper guide member is preferably so formed that a region corresponding to the cross-directional end of the ink sheet protrudes toward the ink sheet with respect to another region corresponding to a cross-directional central portion of the ink sheet. According to this structure, the ink sheet contact portion of the paper guide member can start coming into contact with the cross-directional end of the ink sheet from the cross-directional end region of the ink sheet contact portion and guide transportation of the ink sheet continuously in contact with the cross-directional end of the ink sheet. Therefore, the ink sheet is reliably in contact with the ink sheet contact portion on the cross-directional end thereof, whereby the surface thereof is stretched due to the pressing force received from the ink sheet contact portion. Consequently, wrinkling easily caused on the cross-directional end of the ink sheet can be easily suppressed.

The image generating apparatus according to the aforementioned aspect preferably further comprises a head portion pressing member for pressing the print head against the ink sheet by pressing the upper portion of the print head with prescribed pressing force in printing and an engaging member, mounted on the print head, including an engaging portion for engaging with the head portion pressing member and vertically moving the print head, and the ink sheet guide member is preferably integrally provided on the engaging member. According to this structure, the head portion pressing member so presses the upper portion of the print head that the pressing force thereof can be directly transmitted to the print head. Therefore, the oblong print head having a prescribed printing width in the longitudinal direction can be reliably pressed against the ink sheet with proper pressing force. Further, increase in the number of components constituting the print head can be suppressed dissimilarly to a case of providing the ink sheet guide member independently of the engaging member.

In the aforementioned structure comprising the head portion pressing member and the engaging member, the print head is preferably rotatable between a nonprinting position and a printing position for the paper, and the ink sheet guide member preferably includes a contact portion guiding a transport direction for the ink sheet by coming into contact with the ink sheet along a direction substantially perpendicular to the transport direction for the ink sheet when the print head rotates to the printing position. According to this structure, the ink sheet guide member comes into contact with the ink sheet along the direction substantially perpendicular to the transport direction for the ink sheet due to the contact portion, thereby horizontally uniformly guiding the ink sheet. Thus, the ink sheet can be regularly transported in the direction perpendicular to the contact portion.

In the aforementioned structure including the contact portion, the length of the contact portion of the ink sheet guide member is preferably larger than the cross-directional length of the ink sheet. According to this structure, the contact portion of the ink guide member comes into contact with the overall cross-directional region of the ink sheet, whereby transportation of the ink sheet can be more reliably guided.

In the aforementioned structure including the contact portion, the engaging member integrally provided with the ink sheet guide member is preferably made of sheet metal, and the contact portion of the ink sheet guide member coming into contact with the ink sheet is preferably formed in a U-shaped manner along the transport direction for the ink sheet by folding an end of the engaging member made of sheet metal. According to this structure, the ink sheet guide member can smoothly come into contact with the ink sheet on the contact portion when the ink sheet is taken up in printing, whereby the ink sheet can be prevented from scratching caused by the ink sheet guide member or wrinkling resulting from friction with the contact portion.

In the aforementioned structure comprising the head portion pressing member and the engaging member, the ink sheet guide member preferably has an inclined portion, the engaging member integrally provided with the ink sheet guide member preferably further includes a fixed portion mounted on the print head and a coupling portion connecting the fixed portion and the central portion of the ink sheet guide member with each other, and the inclined portion of the ink sheet guide member is preferably provided on a cross-directional end of the ink sheet guide member not connected with the coupling portion. According to this structure, the portion of the ink sheet guide member not connected with the coupling portion can be easily bent by bending a plate member, whereby the inclined portion of the ink sheet guide member can be easily formed.

In the aforementioned structure comprising the head portion pressing member and the engaging member, the image generating apparatus preferably further comprises a spring member for transmitting the pressing force of the head portion pressing member to the print head through the engaging member, and the engaging member is preferably enabled to fix the spring member. According to this structure, the engaging member may not be separately provided with a member for fixing the spring member, whereby increase in the number of components constituting the print head can be suppressed.

In the image generating apparatus according to the aforementioned aspect, the ink sheet guide member preferably has an inclined portion, the ink sheet is preferably stored in an ink sheet cartridge and taken up on a take-up bobbin of the ink sheet cartridge, the ink sheet guide member is preferably arranged between the print portion of the print head and the take-up bobbin, and the inclined portion of the ink sheet guide member is preferably provided on a cross-directional end of the print head in plan view, to be inclined from the side closer to the take-up bobbin toward the print head. According to this structure, the cross-directional end of the ink sheet is guided from a position closer to the print head with respect to the transport direction for the ink sheet due to the inclined portion of the ink sheet guide member, whereby the print head can more reliably press the ink sheet prevented from wrinkling.

In the image generating apparatus according to the aforementioned aspect, the ink sheet guide member preferably has an inclined portion, and the inclined portion of the ink sheet guide member is preferably provided on a position corresponding to a portion close to the cross-directional end of the ink sheet. According to this structure, the inclined portion of the ink sheet guide member can guide transportation of the ink sheet on the position corresponding to the portion close to the cross-directional end of the ink sheet, whereby the cross-directional end of the ink sheet can be easily prevented from wrinkling due to the inclined portion of the ink sheet guide member.

In the image generating apparatus according to the aforementioned aspect, the ink sheet is preferably stored in an ink sheet cartridge and transported from a supply bobbin of the ink sheet cartridge toward a take-up bobbin in printing, and the paper guide member integrally including the ink sheet contact portion is preferably arranged between the print portion of the print head and the supply bobbin. According to this structure, the ink sheet is transported without wrinkling the cross-directional end thereof on the section held between the print head and the paper guide member in printing, whereby the print head can reliably press the ink sheet prevented from wrinkling.

In the aforementioned structure provided with the ink sheet contact portion having the region protruding toward the ink sheet, the ink sheet contact portion of the paper guide member is preferably formed by an inclined surface curvedly inclined from the cross-directional central portion toward an end of the paper guide member. According to this structure, the ink sheet contact portion can come into contact with the ink sheet from the cross-directional end toward the central portion through the smooth inclined surface, whereby the transported ink sheet can be prevented from scratching or the like resulting from the shape of the ink sheet contact portion.

In the aforementioned structure provided with the ink sheet contact portion formed by the inclined surface, the length of the ink sheet contact portion of the paper guide member is preferably larger than the cross-directional length of the ink sheet. According to this structure, the transported ink sheet can be more reliably prevented from scratching or the like dissimilarly to a case where the cross-directional end of the ink sheet contact portion abruptly wrinkles or scratches the ink sheet by coming into contact with the ink sheet.

In the image generating apparatus according to the aforementioned aspect, the paper guide member is preferably made of resin, and the surface of the ink sheet contact portion of the paper guide member is preferably rounded along the transport direction for the ink sheet. According to this structure, the ink sheet contact portion can smoothly come into contact with the ink sheet also in the transport direction when the ink sheet is taken up in printing, whereby the ink sheet can be prevented from scratching caused by the ink sheet contact portion or wrinkling resulting from friction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a sublimatic printer 100 according to the embodiment of the present invention is described with reference to FIGS. 1 to 4. According to this embodiment, the present invention is applied to the sublimatic printer 100 employed as an exemplary image generating apparatus.

Figure 1:
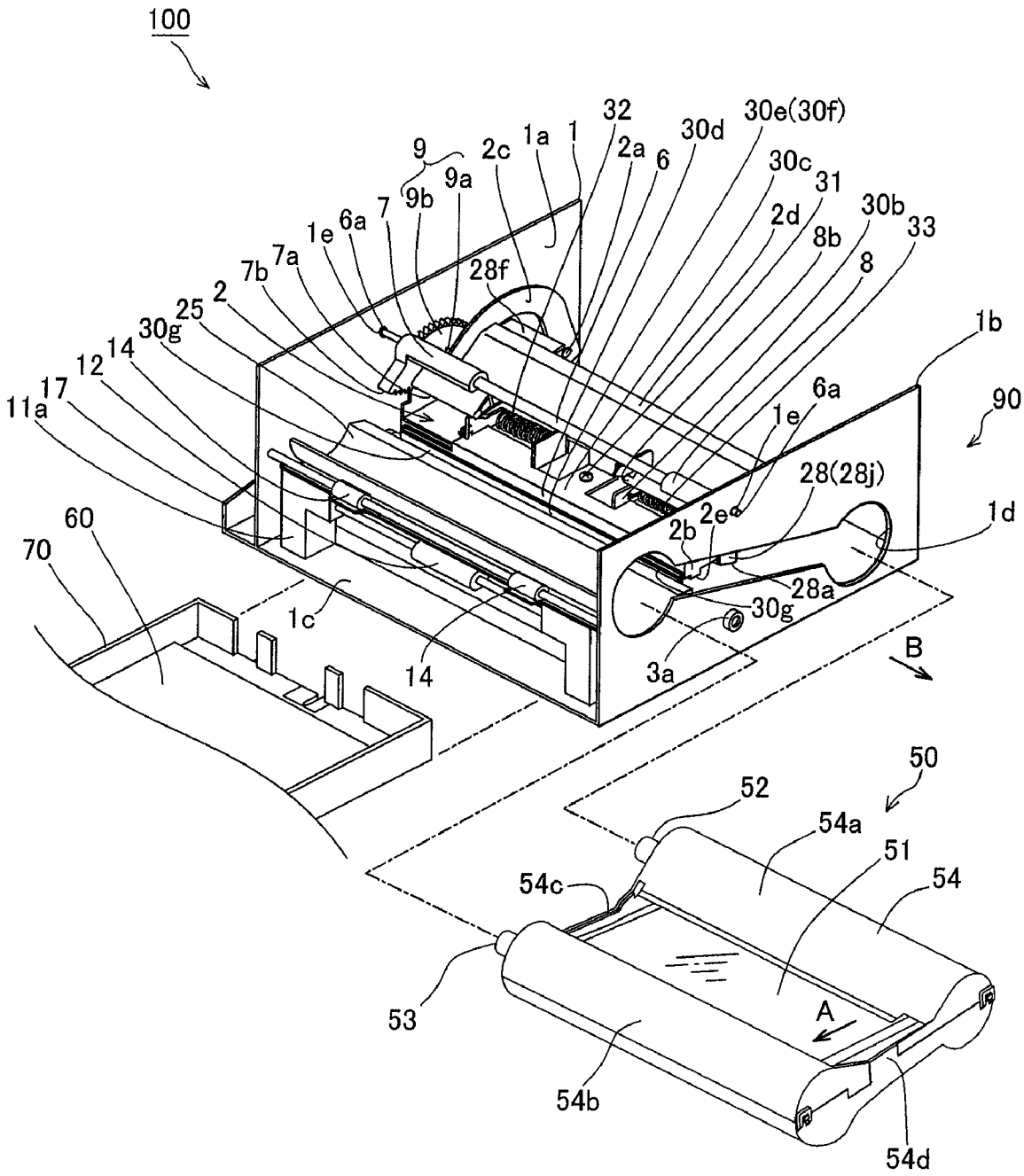
FIG. 1 is an exploded perspective view showing the overall structure of a sublimatic printer according to an embodiment of the present invention.
Figure 2:
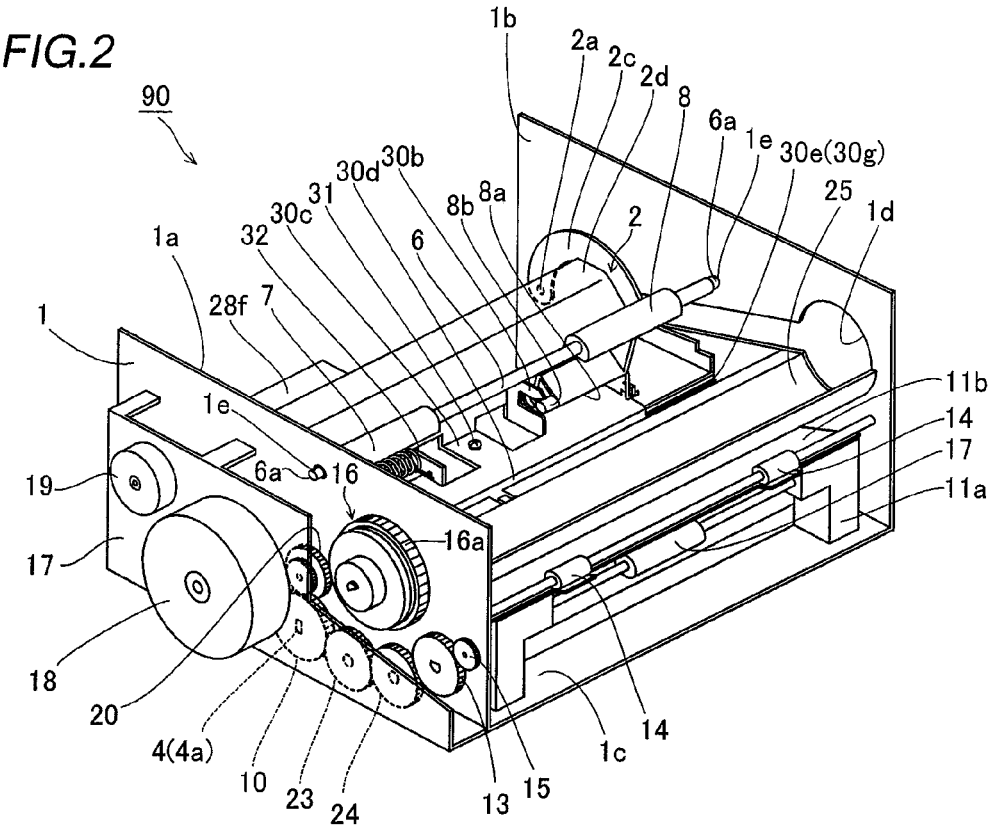
FIG. 2 is a perspective view of the sublimatic printer according to the embodiment shown in FIG. 1.
Figure 3:
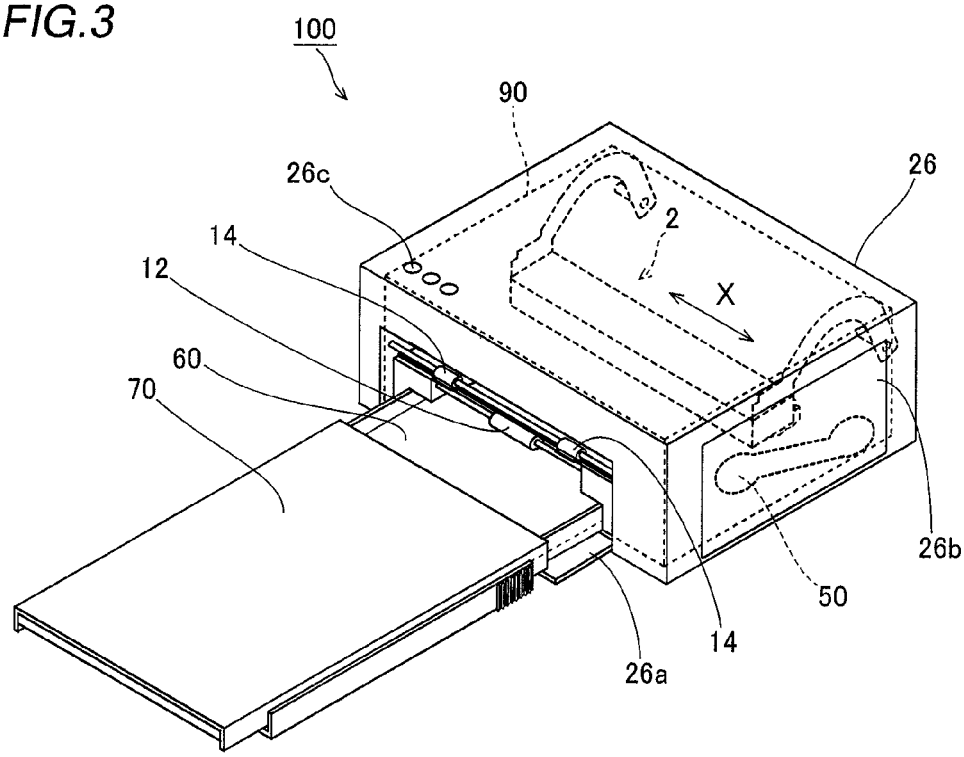
FIG. 3 is another exploded perspective view showing the overall structure of the sublimatic printer according to the embodiment shown in FIG. 1.

A printer body 90 of the sublimatic printer 100 according to the embodiment of the present invention comprises a chassis 1 of metal, a print head 2 for printing, a platen roller 3 (see FIG. 4) opposed to the print head 2, a feed roller 4 (see FIG. 4) of metal, a press roller 5 (see FIG. 4) of metal pressing the feed roller 4 with prescribed pressing force, a support rod 6 of metal, head portion pressing members 7 and 8 for pressing the upper portion of the print head 2 with prescribed pressing force, a driving gear 9 of resin, a feed roller gear 10 (see FIG. 5), a lower paper guide 11*a* of resin, an upper paper guide 11*b* (see FIG. 4) of resin, a paper feed roller 12 of rubber, a paper feed roller gear 13 (see FIG. 2), a paper discharge roller 14 of rubber, a paper discharge roller gear 15 (see FIG. 2), a take-up reel 16 (see FIG. 2), a motor bracket 17 (see FIG. 2), a stepping motor 18 (see FIG. 2) for transporting papers 60, another stepping motor 19 (see FIG. 2) serving as a driving source for rotating the print head 2, a swingable swing gear 20 (see FIG. 5), a plurality of intermediate gears 21 to 24 (see FIG. 5) and a cartridge support portion 25 supporting an ink sheet cartridge 50 storing an ink sheet 51, as shown in FIG. 1. The printer body 90 is arranged in a housing 26 of resin, as shown in FIG. 3. In the sublimatic printer 100 according to this embodiment, the ink sheet cartridge 50 and a paper feed cassette 70 for storing the papers 60 supplied to the printer body 90 are detachably mounted on the printer body 90, as shown in FIG. 3.

As shown in FIG. 1, the chassis 1 has a first side surface 1*a* and a second side surface 1*b* opposed to each other and a bottom surface 1*c*. The aforementioned motor bracket 17 (see FIG. 2) is mounted on the first side surface 1*a* of the chassis 1. The second side surface 1*b* of the chassis 1 opposite to the first side surface 1*a* is provided with a cartridge receiving hole 1*d* for receiving the ink sheet cartridge 50. The first and second side surfaces 1*a* and 1*b* of the chassis 1 are provided with support holes 1*e* rotatably supporting the support rod 6 mounted with the heat portion pressing members 7 and 8 respectively, as shown in FIG. 1. The bottom surface 1*c* of the chassis 1 is provided with paper sensors 27*a* and 27*b* for detecting front and rear ends 60*a* and 60*b* of each paper 60 in printing, as shown in FIG. 4.

Figure 4:
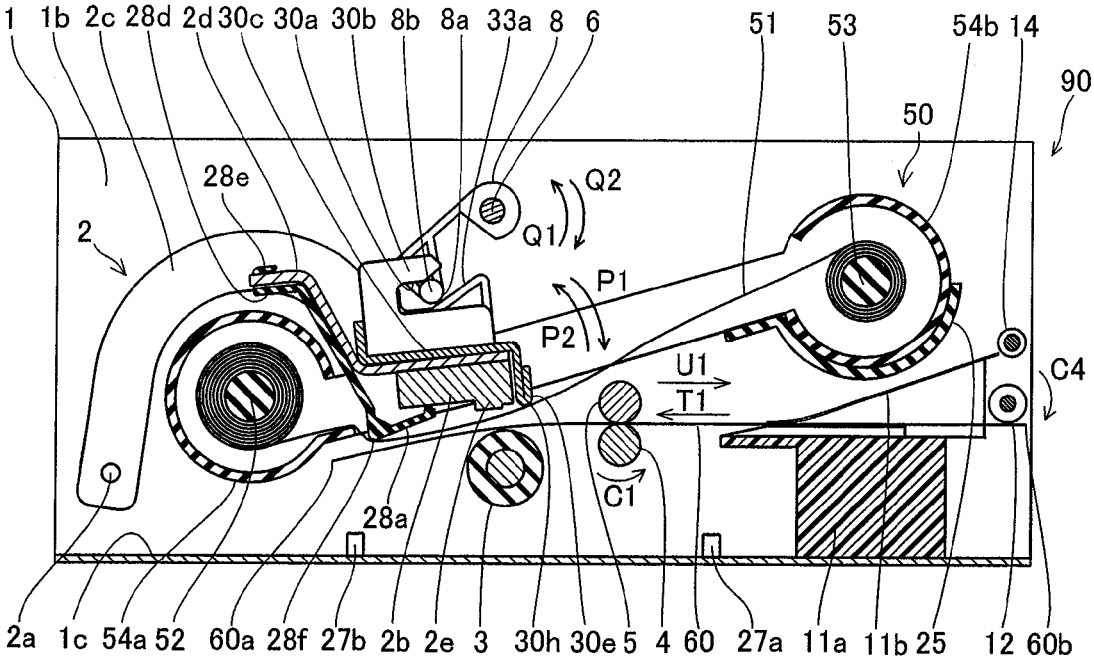
FIG. 4 is a sectional view showing the internal structure of the sublimatic printer according to the embodiment shown in FIG. 1.
Figure 5:
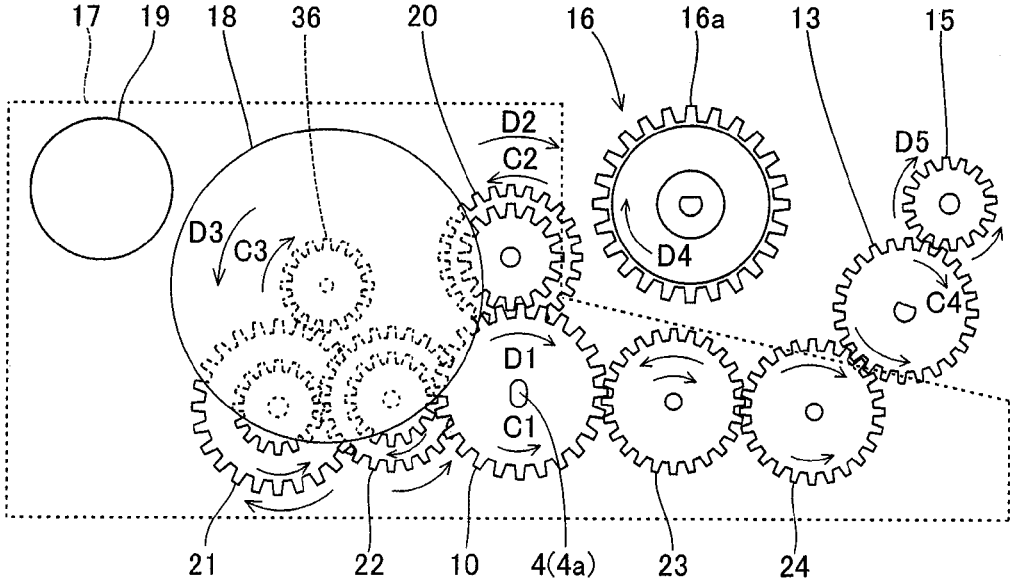
FIG. 5 illustrates the arrangement of gears of the sublimatic printer according to the embodiment shown in FIG. 1.

Two platen roller bearings 3*a* are mounted on the first and second side surfaces 1*a* and 1*b* of the chassis 1 respectively as shown in FIG. 1, for rotatably supporting the platen roller 3 (see FIG. 4). The feed roller 4 has a feed roller gear insertion portion 4*a* inserted into the feed roller gear 10, as shown in FIG. 5. The feed roller 4 is rotatably supported by a feed roller bearing (not shown) mounted on the chassis 1. The press roller 5 (see FIG. 4) is also rotatably supported by a press roller bearing (not shown). The feed roller 4 and the press roller 5 rotate in a state holding each paper 60 therebetween as show in FIG. 4, thereby transporting the paper 60 in a paper feed direction (along arrow T1) or a paper discharge direction (along arrow U1). The paper feed roller 12 transports the papers 60 stored in the paper feed cassette 70 (see FIG. 1) into the chassis 1, as shown in FIG. 3. The paper discharge roller 14 transports each printed paper 60 from the chassis 1, as shown in FIG. 3.

Figure 7:
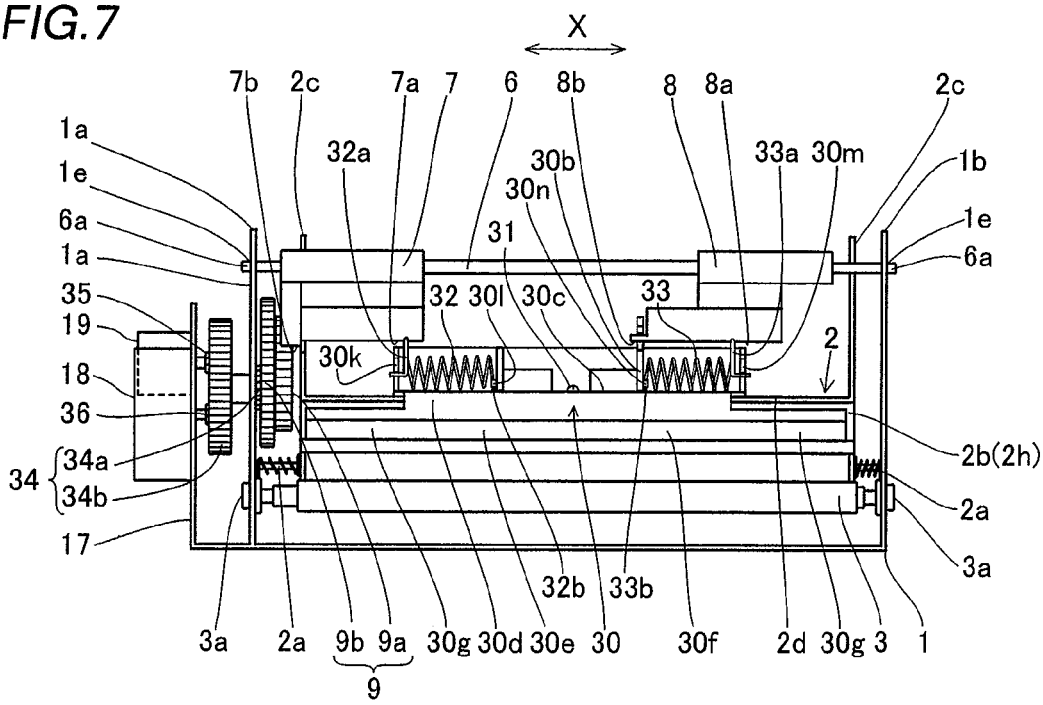
FIG. 7 is a front elevational view of the sublimatic printer according to the embodiment shown in FIG. 1.

First and second support portions 6*a* are provided on first and second ends of the support rod 6 respectively, as shown in FIG. 7. The first and second support portions 6*a* of the support rod 6 are rotatably inserted into the support holes 1*e* provided in the first and second side surfaces 1*a* and 1*b* of the chassis 1 respectively, as shown in FIG. 7. The head portion pressing members 7 and 8 are mounted inside the first and second ends of the support rod 6 respectively in an unidling manner with respect to the support rod 6, as shown in FIG. 7.

The head portion pressing member 7 is integrally provided with a pressing portion 7*a* and a gear portion 7*b*, as shown in FIG. 1. The head portion pressing member 8 is integrally provided with a pressing portion 8*a* and a protrusion 8*b* protruding in the extensional direction of the support rod 6, as shown in FIG. 2.

The head portion pressing members 7 and 8 are provided with D-shaped receiving holes 7*c* and 8*c* respectively, for receiving insertion portions 6*b* provided in the vicinity of both ends of the support rod 6 respectively. Thus, the support rod 6 and the head portion pressing member 8 are rotatable following rotation of the head portion pressing member 7. The head portion pressing members 7 and 8 are arranged closer to the first and second side surfaces 1*a* and 1*b* of the chassis 1 respectively, as shown in FIGS. 1 and 2.

The print head 2 includes a pair of support shafts 2*a*, a head portion 2*b* opposed to the platen roller 3 (see FIG. 4), a pair of arm portions 2*c* coupling the support shafts 2*a* and the head portion 2*b* with each other, a heat radiating portion 2*d* of aluminum for radiating heat from the head portion 2*b* in printing and a print portion 2*e* so provided as to protrude from the lower surface of the head portion 2*b*, as shown in FIGS. 1 and 4.

Figure 8:
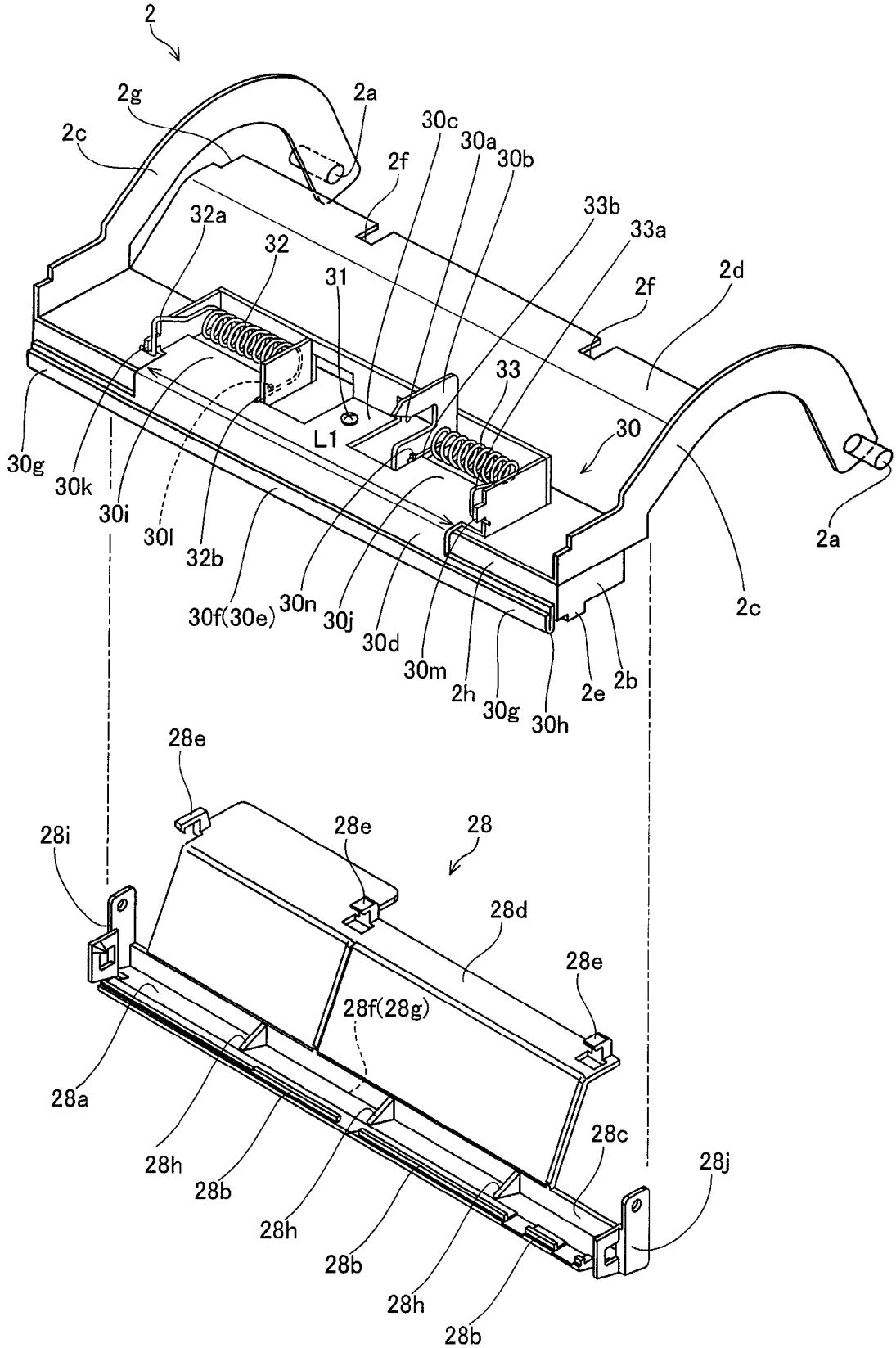
FIG. 8 is a perspective view showing the structure of a print head of the sublimatic printer according to the embodiment shown in FIG. 1 in detail.
Figure 9:
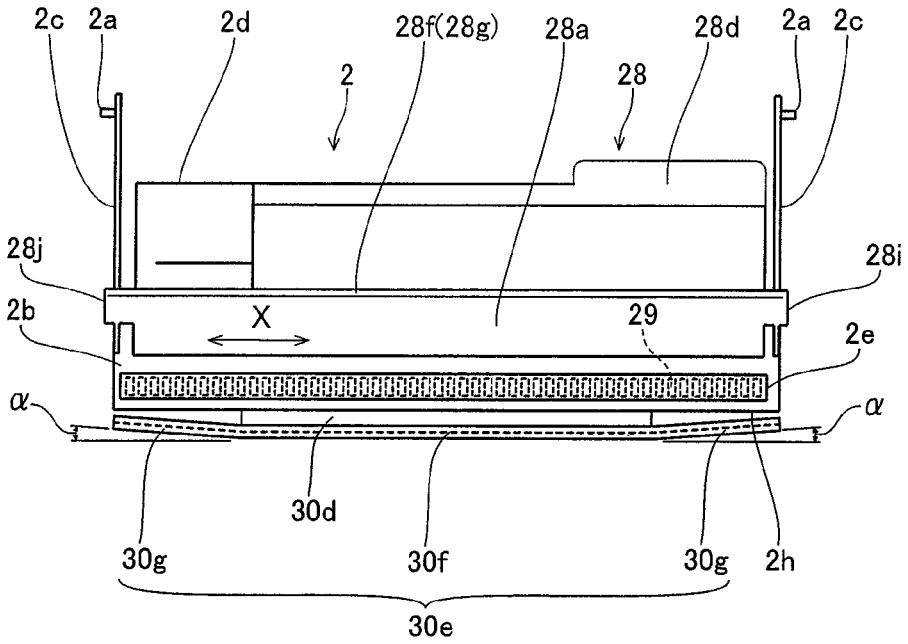
FIG. 9 is a bottom plan view of the print head of the sublimatic printer according to the embodiment shown in FIG. 1.

According to this embodiment, a paper guide member 28 of resin is mounted on the head portion 2*b* from below the print head 2 as a separate member, as shown in FIGS. 8 and 9. The paper guide member 28 rotates along arrow P1 with the print head 2 when starting printing and stands still on a prescribed position thereby controlling a transport direction for each paper 60 after the front end 60*a* of the paper 60 transported in the printer body 90 along arrow T1 passes through the space between the print head 2 and the platen roller 3, as shown in FIG. 4. More specifically, the front end 60*a* of the paper 60 substantially horizontally passing through the space between the print head 2 and the platen roller 3 comes into contact with the lower surface of a paper guide portion 28*a* of the paper guide member 28 through the ink sheet 51 to be guided obliquely downward, as shown in FIG. 4. Thus, the front end 60*a* of the paper 60 is inhibited from accidentally entering a supply bobbin storage portion 54*a* of the ink sheet cartridge 50 described later.

As shown in FIG. 8, ribs 28*b* provided on the front end of the paper guide portion 28*a* for supporting the lower surface of the head portion 2*b* of the print head 2, a vertical wall 28*c* provided on the rear end of the paper guide portion 28*a* to extend upward and a mounting portion 28*d* further extending obliquely upward from the vertical wall 28*c* and having a plurality of hooks 28*e* (formed on three portions in this embodiment) for mounting the paper guide member 28 on the heat radiating portion 2*d* of the print head 2 are integrally formed on the paper guide member 28 of resin. The paper guide member 28 is mounted on the heat radiating portion 2*d* through the hooks 28*e* engaging with notches 2*f* (formed on two portions) and 2*g* (formed on one portion) provided on the heat radiating portion 2*d* of the print head 2 respectively, as shown in FIG. 8.

Figure 10:
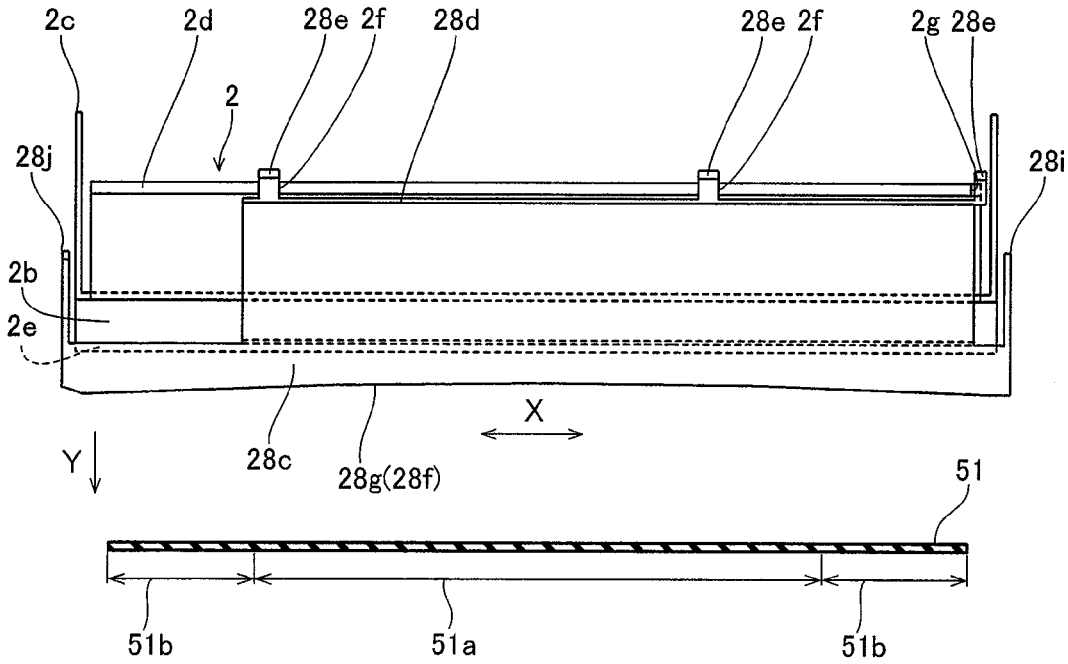
FIGS. 10 and 11 illustrate the positional relation between the print head of the sublimatic printer according to the embodiment shown in FIG. 1 and an ink sheet.

According to this embodiment, an ink sheet contact portion 28*f* so bent that the cross-directional ends thereof protrude downward (along arrow Y) with respect to the central portion of the paper guide member 28 in the cross direction (along arrow X) and so formed that regions corresponding to cross-directional end regions 51*b* (along arrow X) of the ink sheet 51 can apply tension to these cross-directional end regions 51*b* (along arrow X) of the ink sheet 51 is provided on the rear end of the paper guide portion 28*a* connected with the vertical wall 28*c* along the cross direction (along arrow X) of the paper guide portion 28*a*, as shown in FIG. 10. The ink sheet contact portion 28*f* is formed by an inclined surface 28*g* curvedly inclined from the central portion of the ink sheet contact portion 28*f* toward the cross-directional ends (along arrow X) along the cross direction (arrow X). The length of the ink sheet contact portion 28*f* provided on the paper guide member 28 is larger than the cross-directional length of the ink sheet 51. When the print head 2 comes into contact with the ink sheet 51 from above along arrow Y for starting printing, therefore, the cross-directional ends (along arrow X) of the ink sheet contact portion 28*f* can come into contact with the cross-directional end regions 51*b* (along arrow X) of the ink sheet 51 in advance of a cross-directional central region 51*a* (along arrow X) of the ink sheet 51, as shown in FIG. 10.

Figure 12:
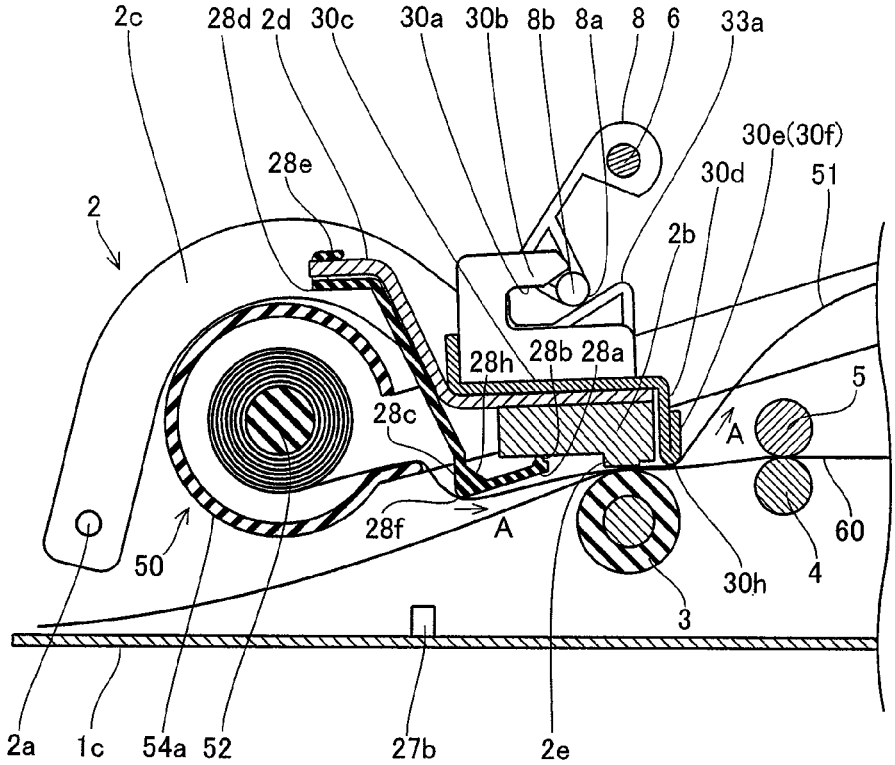
FIG. 12 illustrates the print head of the sublimatic printer according to the embodiment shown in FIG. 1 in a state pressing a platen roller.
Figure 14:
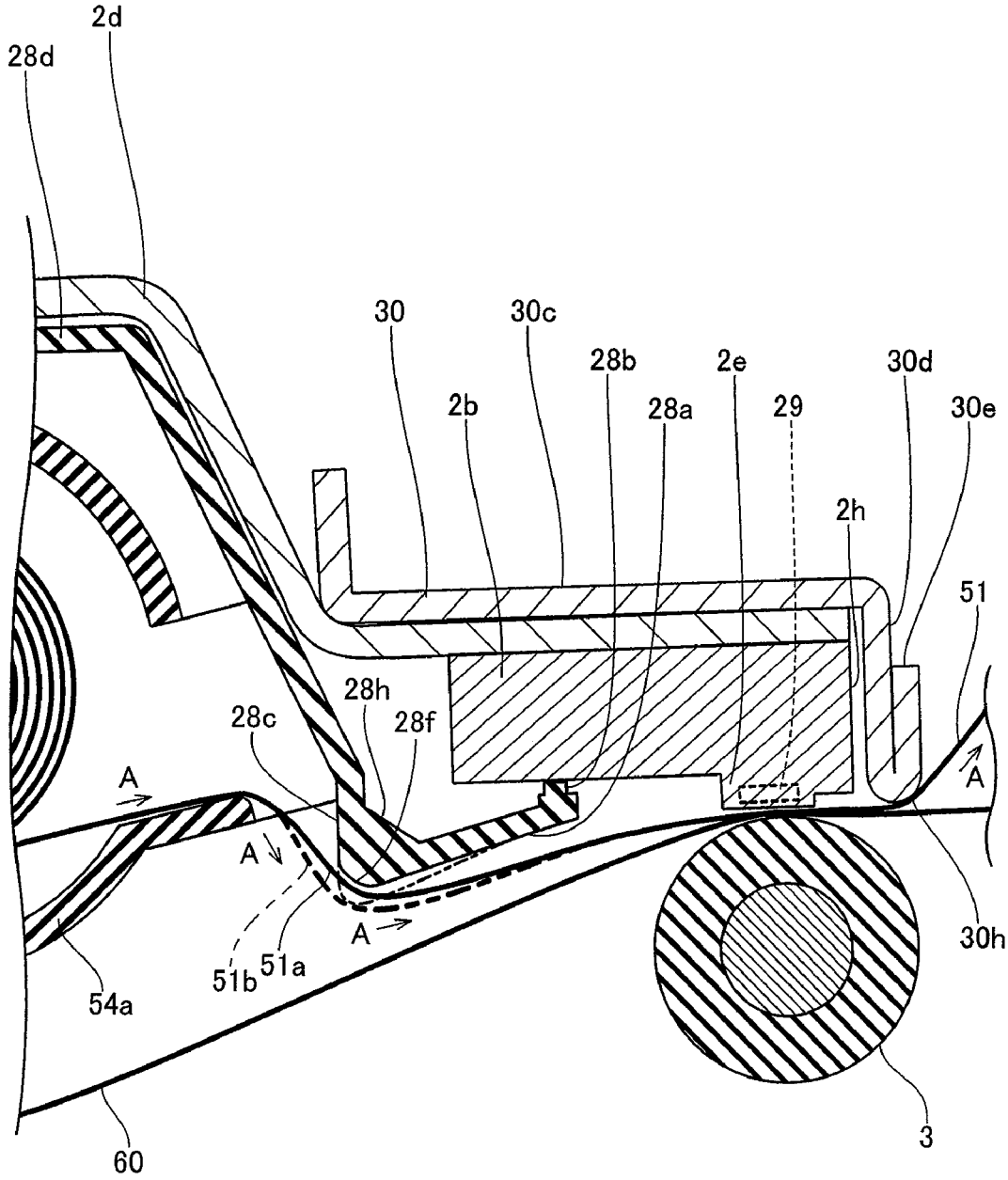
FIG. 14 is an enlarged view showing a portion around a paper guide member with reference to the print head of the sublimatic printer according to the embodiment shown in FIG. 1 in the state pressing the platen roller.

According to this embodiment, the surface (corresponding to the inclined surface 28*g* curved in the cross direction) of the ink sheet contact portion 28*f* is rounded along a transport direction (along arrow A in FIG. 14) for the ink sheet 51, to be smoothly contactable with each cross-directional end region 51*b* (shown by a thick two-dot chain line) of the ink sheet 51 transported in a printing operation, as shown in FIG. 14. In printing, therefore, the ink sheet contact portion 28*f* of the paper guide member 28 transports the ink sheet 51 toward the print portion 2*e* of the print head 2 while changing the transport direction (take-up direction) therefor from an oblique downward direction to a substantially horizontal direction immediately after the same is delivered from a supply bobbin 52, as shown in FIG. 12.

As shown in FIG. 8, the paper guide member 28 is further provided with ribs 28*h* (formed on three portions in this embodiment) inside the rear end of the paper guide portion 28*a*, in order to ensure bonding strength between the paper guide portion 28*a* and the vertical wall 28*c*. The paper guide member 28 is further provided with fixing portions 28*i* and 28*j* for positioning and fixing the paper guide member 28 in the cross direction (along arrow X) when mounted on the print head 2 on horizontal ends thereof respectively, as shown in FIG. 8.

Figure 6:
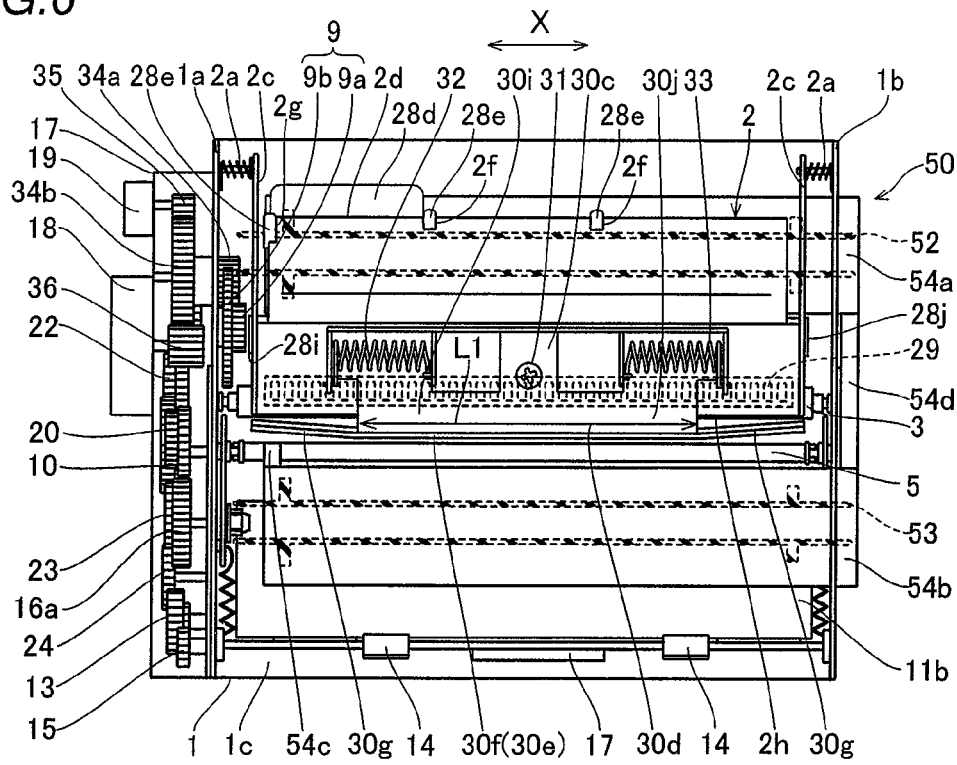
FIG. 6 is a top plan view of the sublimatic printer according to the embodiment shown in FIG. 1.

As shown in FIG. 6, a plurality of heating elements 29 (shown by broken lines) are embedded in the print portion 2*e* of the head portion 2*b* along the cross direction (along arrow X in FIG. 6). The print head 2 is vertically rotatable (along arrows P1 and Q1) about the pair of support shafts 2*a* mounted inside the first and second side surfaces 1*a* and 1*b* of the chassis 1 respectively, as shown in FIG. 4.

According to this embodiment, an engaging member 30 of sheet metal is mounted on the upper surface of the heat radiating portion 2*d* of the print head 2 with a screw 31, as show in FIGS. 1 and 8. As shown in FIG. 8, the engaging member 30 is integrally provided with an engaging portion 30*b* for vertically moving the print head 2 (see FIG. 4) by engaging a notch 30*a* thereof with the protrusion 8*b* (see FIG. 4) of the head portion pressing member 8 (see FIG. 4), a fixed portion 30*c* fixed to the upper surface of a part of the heat radiating portion 2*d* corresponding to the head portion 2*b*, a coupling portion 30*d*, having the same size (corresponding to a length L1 in FIG. 11) as the fixed portion 30*c* in the cross direction (along arrow X in FIG. 8), bent from the fixed portion 30*c* substantially vertically downward to extend on the side of a front surface 2*h* of the print head 2 and an ink sheet guide portion 30*e* extending from the coupling portion 30*d* along the cross direction (along arrow X in FIG. 8) of the print head 2. The ink sheet guide portion 30*e* is an example of the "ink sheet guide member" in the present invention.

Figure 11:
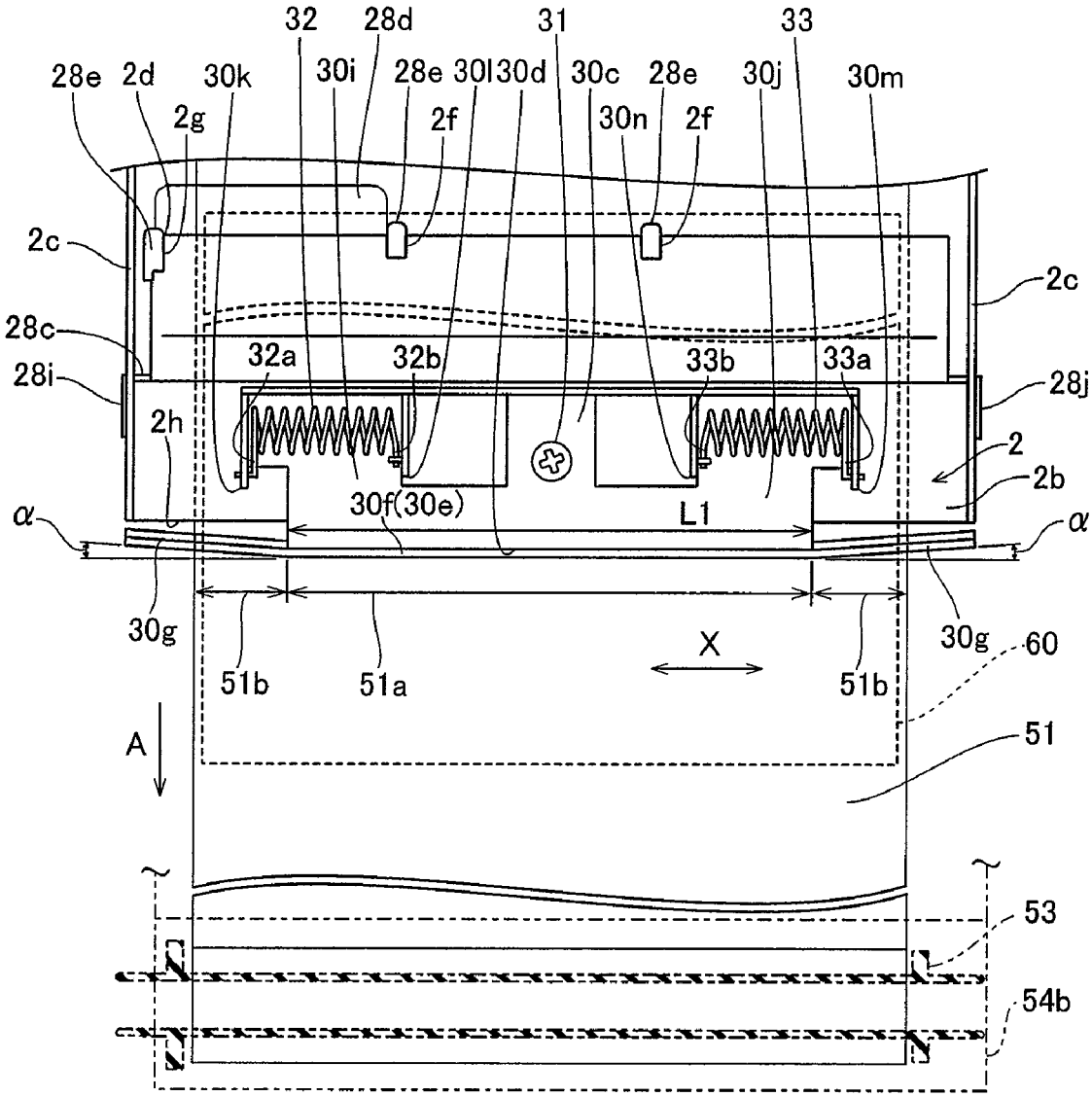

According to this embodiment, the ink sheet guide portion 30*e* is constituted of a flat portion 30*f* provided on a prescribed region of the cross-directional central portion (along arrow X) of the print head 2 and inclined portions 30*g* provided on both cross-directional ends (along arrow X) of the print head 2 and bent along the extensional direction of the flat portion 30*f* toward the front surface 2*h* of the head portion 2*b* to be inclined at a constant angle $\alpha$ in plan view, as shown in FIGS. 9 and 11. The flat portion 30*f* is an example of the "central portion" in the present invention. The ink sheet guide portion 30*e* is arranged between the print portion 2*e* of the print head 2 and a take-up bobbin 53 (see FIG. 6) of the ink sheet cartridge 50 described later, as shown in FIGS. 6 and 12. Therefore, the ink sheet guide portion 30*e* is convexed toward the take-up direction (along arrow A in FIG. 11) in plan view due to the flat portion 30*f* and the inclined portions 30*g*, as shown in FIG. 11.

According to this embodiment, the flat portion 30*f* of the ink sheet guide portion 30*e* has the length L1 (along the cross direction (along arrow X) of the print head 2) substantially identical to the length of the coupling portion 30*d* while the inclined portions 30*g* extend from cross-directional ends (corresponding to both ends of the flat portion 30*f*) of the ink sheet guide portion 30*e* not connected to the coupling portion 30*d* toward outer sides (cross-directional ends of the ink sheet 51), as shown in FIG. 11. The length (total length of the flat portion 30*f* and the two inclined portions 30*g*) of the ink sheet guide portion 30*e* is larger than the cross-directional length (along arrow X in FIG. 11) of the ink sheet 51. When the print head 2 rotates (from the position shown in FIG. 4 to that shown in FIG. 11) for printing, the flat portion 30*f* and the inclined portions 30*g* of the ink sheet guide portion 30*e* are arranged on positions corresponding to the cross-directional central region 51*a* and the end regions 51*b* of the ink sheet 51 respectively, as shown in FIG. 10.

Figure 13:
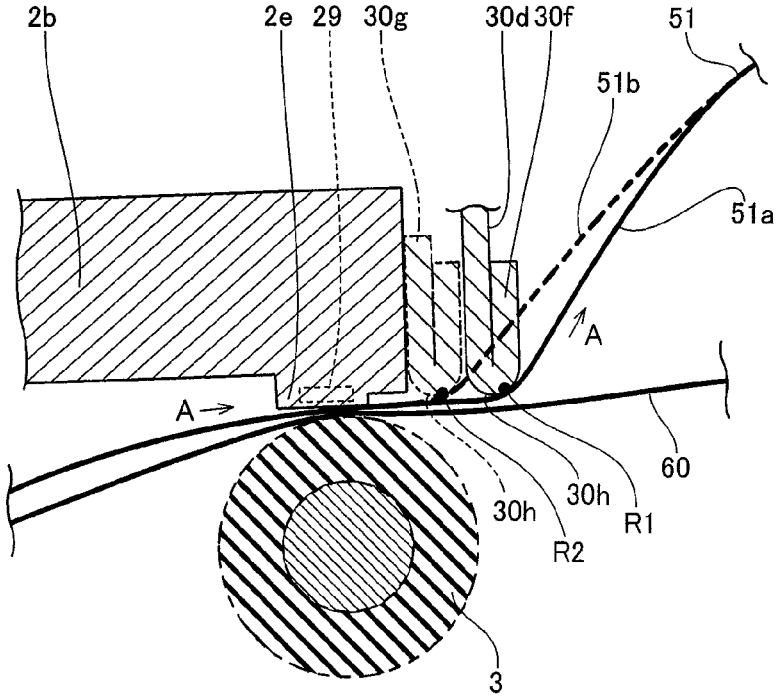
FIG. 13 is an enlarged view showing a portion around an ink sheet guide member with reference to the print head of the sublimatic printer according to the embodiment shown in FIG. 1 in the state pressing the platen roller.

According to this embodiment, a contact portion 30*h* of the ink sheet guide portion 30*e* coming into contact with the ink sheet 51 from above in printing is formed by folding a sheet metal member substantially by 180° to be U-shaped along the transport direction (along arrow A in FIG. 12) for the ink sheet 51 for smoothly coming into contact with the ink sheet 51, as shown in FIG. 12. In printing, therefore, the ink sheet 51 delivered from the supply bobbin 52 is taken up on the take-up bobbin 53 (see FIG. 4) immediately after passing through the print portion 2*e* of the print head 2 along arrow A while the contact portion 30*h* of the ink sheet guide portion 30*e* changes the transport direction (take-up direction) from the substantially horizontal direction to an obliquely upward direction, as shown in FIG. 12. At this time, the contact portion 30*h* changes the transport direction obliquely upward on positions R1 and R2 (shown by black circles) of the flat portion 30*f* and each inclined portion 30*g* (shown by a thin two-dot chain line) of the ink sheet guide portion 30*e* for the central region 51*a* (shown by a solid line) and each end region 51*b* (shown by a thick two-dot chain line) of the ink sheet 51 respectively, as shown in FIG. 13. Therefore, the ink sheet 51 passes through the contact portion 30*h* of the ink sheet guide portion 30*e* while warping from the central region 51*a* coming into contact with the flat portion 30*f* of the ink sheet guide portion 30*e* toward the end regions 51*b* coming into contact with the inclined portions 30*g* in the cross direction (along arrow X in FIG. 11) of the ink sheet 51.

According to this embodiment, first and second spring fixing portions 30*i* and 30*j* are integrally provided on a region of the engaging member 30 located above the head portion 2*b*, as shown in FIG. 8. First and second torsion coil springs 32 and 33 for urging the head portion 2*b* toward the platen roller 3 (see FIGS. 7 and 12) are arranged on regions of the first and second spring fixing portions 30*i* and 30*j* corresponding to the head portion pressing members 7 and 8 (see FIG. 7) respectively. The first and second torsion coil springs 32 and 33 are examples of the "spring member" in the present invention respectively. The first and second spring fixing portions 30*i* and 30*j* of the engaging member 30 are arranged at a prescribed interval in the axial direction of the platen roller 3 (see FIG. 7), as shown in FIGS. 7 and 8. The first and second torsion coil springs 32 and 33 are fixed to the first and second spring fixing portions 30*i* and 30*j* of the engaging member 30 respectively, as shown in FIG. 8. The first spring fixing portion 30*i* of the engaging member 30 is provided with a stop portion 30*k* and a protrusion 30*l*, as shown in FIG. 8. The second spring fixing portion 30*j* of the engaging member 30 is also provided with a stop portion 30*m* and a protrusion 30*n*, as shown in FIG. 8.

According to this embodiment, the first torsion coil spring 32 has a first end 32*a* pressed by the pressing portion 7*a* (see FIG. 7) of the head portion pressing member 7 (see FIG. 7) upon downward rotation of the head portion pressing member 7 (see FIG. 7) and a second end 32*b* transmitting urging force resulting from the pressed first end 32*a* to the upper surface (upper portion) of the head portion 2*b* through the fixed portion 30*c*, as shown in FIGS. 7 and 8. The second torsion coil spring 33 also has a first end 33*a* pressed by the pressing portion 8*b* (see FIG. 7) of the head portion pressing member 8 (see FIG. 7) upon downward rotation of the head portion pressing member 8 (see FIG. 7) and a second end 33*b* transmitting urging force resulting from the pressed first end 33*a* to the upper surface (upper portion) of the head portion 2*b* through the fixed portion 30*c*, as shown in FIGS. 7 and 8. Therefore, the print portion 2*e* of the head portion 2*b* can be pressed against the platen roller 3 with prescribed pressing force due to the urging force of the first and second coil springs 32 and 33 transmitted to the upper surface (upper portion) of the head portion 2*b*, as shown in FIGS. 6 and 7.

The first end 32*a* of the first torsion coil spring 32 is stopped on the stop portion 30*k* of the engaging member 30, while the second end 32*b* thereof is fixed to the protrusion 30*l* of the engaging member 30, as shown in FIGS. 7 and 8. The first end 33*a* of the second torsion coil spring 33 is stopped on the stop portion 30*m* of the engaging member 30, while the second end 33*b* thereof is fixed to the protrusion 30*n* of the engaging member 30, as shown in FIGS. 7 and 8.

When the head portion pressing member 8 rotates upward (along arrow Q2), the protrusion 8*b* of the head portion pressing member 8 and the notch 30*a* of the engaging portion 30*b* so engage with each other that the head portion 2*b* also rotates upward (along arrow P2), as shown in FIG. 4. Consequently, the head portion 2*b* pressed against the platen roller 3 separates from the platen roller 3 upward upon the upward rotation of the head portion pressing member 8 (along arrow Q2), as show in FIG. 4. The opening side of the notch 30*a* is so chamfered as to easily engage with the protrusion 8*b*.

As shown in FIGS. 1 and 6, the driving gear 9 and the intermediate gear 34 (see FIG. 6) are so provided as to transmit the driving force of the stepping motor 19 (see FIG. 2) to the head portion pressing members 7 and 8 thereby rotating the head portion pressing members 7 and 8. The driving gear 9 is mounted on the inner side of the first side surface 1*a* of the chassis 1. The intermediate gear 34 and the stepping motor 19 are mounted on the outer side of the first side surface 1*a* of the chassis 1 through the motor bracket 17, as shown in FIG. 2. A small-diametral gear portion 9*a* of the driving gear 9 meshes with the gear portion 7*b* of the head portion pressing member 7 while a large-diametral gear portion 9*b* of the driving gear 9 meshes with a small-diametral gear 34*a* of the intermediate gear 34 (see FIG. 6), as shown in FIG. 6. Further, a large-diametral gear 34*b* of the intermediate gear 34 meshes with a motor gear 35 of the stepping motor 19, as shown in FIG. 6. Thus, the driving force of the stepping motor 18 can be transmitted to the head portion pressing members 7 and 8 through the intermediate gear 34 and the driving gear 9.

As shown in FIG. 5, a motor gear 36 is mounted on the shaft of the stepping motor 18 mounted on the motor bracket 17. The stepping motor 18 functions as a driving source for driving a gear portion 16*a* of the take-up reel 16, the paper feed roller gear 13, the paper discharge roller gear 15 and the feed roller gear 10.

The take-up reel 16 is so formed as to engage with the take-up bobbin 53 arranged in a take-up bobbin storage portion 54*b* of the ink sheet cartridge 50 described later thereby taking up the ink sheet 51 wound on the take-up bobbin 53, as shown in FIG. 5. The gear portion 16*a* of the take-up reel 16 meshes with the swing gear 20 upon swinging thereof, as shown in FIG. 5.

The lower paper guide 11*a* is set in the vicinity of the feed roller 4 and the press roller 5, as shown in FIG. 4. The upper paper guide 11*b* is mounted on the upper portion of the lower paper guide 11*a*. The upper paper guide 11*b* can guide the papers 60 to a paper feed path toward a printing portion through the lower surface thereof in paper feeding while guiding the same to a paper discharge path through the upper surface thereof in paper discharge.

The housing 26 includes lid members 26*a* and 26*b* and pushbutton switches 26*c*, as shown in FIG. 3. The lid members 26*a* and 26*b* are outwardly rotatable from the housing 26 about the lower ends thereof, as shown in FIG. 3. The lid member 26*a* of the housing 26 is openable/closable for mounting the paper feed cassette 70 on the printer body 90, as shown in FIG. 3. When the paper feed cassette 70 is dismounted, the lid member 26*a* is so closed as to prevent dust etc. from entering the printer body 90. On the other hand, the lid member 26*b* of the housing 26 is openable/closable for mounting the ink sheet cartridge 50 on the printer body 90, as shown in FIG. 3. When the ink sheet cartridge 50 is neither mounted on nor dismounted from the printer body 90, the lid member 26*b* is so closed as to prevent dust etc. from entering the printer body 90. The pushbutton switches 26*c* of the housing 26 are operated by the user for starting printing, as shown in FIG. 3.

The ink sheet cartridge 50 includes the supply bobbin 52 for supplying the ink sheet 51 and the take-up bobbin 53 for taking up the supplied ink sheet 51 along arrow A, as shown in FIG. 1. A cartridge case 54 constituting the ink sheet cartridge 50 is constituted of the supply bobbin storage portion 54*a* rotatably storing the supply bobbin 52, the take-up bobbin storage portion 54*b* rotatably storing the take-up bobbin 53 and a pair of coupling portions 54*c* and 54*d* coupling the supply bobbin storage portion 54*a* and the take-up bobbin storage portion 45*b* with each other at a prescribed distance, as shown in FIG. 1. When the supply bobbin storage portion 54*a* and the take-up bobbin storage portion 54*b* store the supply bobbin 52 and the take-up bobbin 53 respectively, therefore, the ink sheet 51 wound on the supply bobbin 52 and the take-up bobbin 53 is exposed on the space of the prescribed distance between the supply bobbin storage portion 54*a* and the take-up bobbin storage portion 54*b*, as shown in FIGS. 1 and 4. The ink sheet 51 is formed by successively linking ink sheets of three colors, i.e., Y (yellow), M (magenta) and C (cyan) with each other. The supply bobbin storage portion 54*a* and the take-up bobbin storage portion 54*b* of the ink sheet cartridge 50 are provided with helical compression springs (not shown) therein respectively. These helical compression springs regularly urge the ink sheet cartridge 50 mounted on the printer body 90 in an ink sheet cartridge discharge direction (along arrow B in FIG. 1).

The printing operation of the sublimatic printer 100 according to this embodiment is now described with reference to FIGS. 1, 3 to 7 and 10 to 17.

Figure 15:
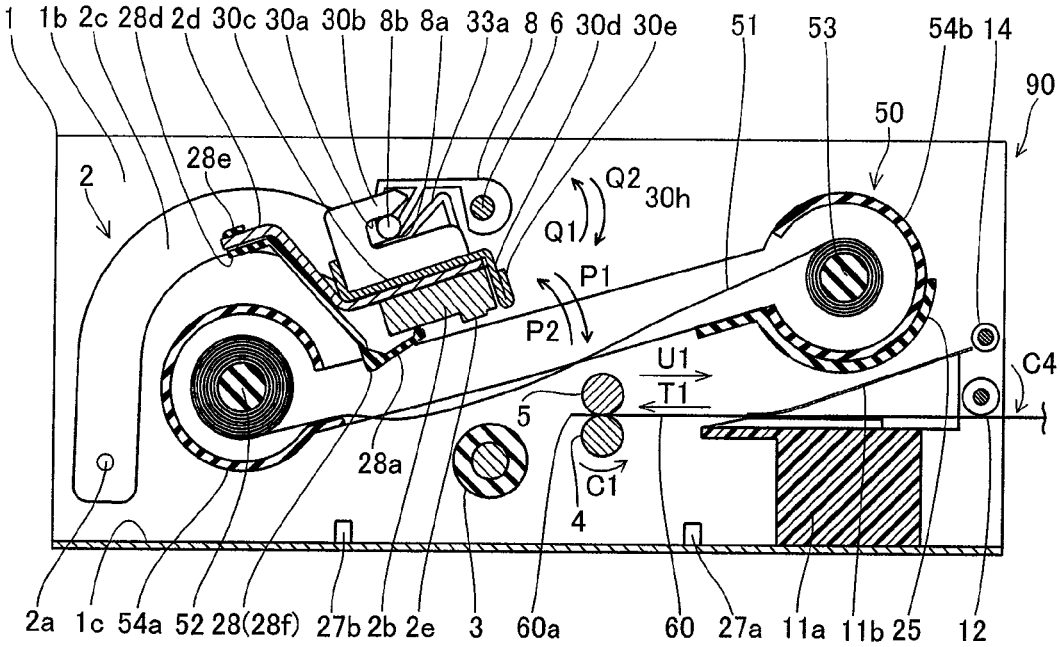
FIGS. 15 to 17 are diagrams for illustrating a printing operation of the sublimatic printer according to the embodiment shown in FIG. 1.

Before starting printing, the head portion 2*b* of the print head 2 is held on a position upwardly separating from the platen roller 3, as shown in FIG. 15. In this case, the protrusion 8*b* of the head portion pressing member 8 is in engagement with the engaging portion 30*b* (more strictly, the notch 30*a*) of the engaging member 30 provided on the upper portion of the head portion 2*b*, thereby inhibiting the head portion 2*b* from rotation along arrow P1.

When the user presses any of the pushbutton switches 26*c* (see FIG. 3) to start the printing operation, the stepping motor 19 (see FIG. 6) is so driven that the driving force thereof is transmitted to the gear portion 7*b* (see FIG. 7) of the head portion pressing member 7 (see FIG. 7) through the large- and small-diametral gear portions 34*b* and 34*a* (see FIG. 6) of the intermediate gear 34 (see FIG. 6) and the driving gear 9 (see FIG. 6), whereby the head portion pressing member 7 (see FIG. 7) rotates along arrow Q1 about the support rod 6. At this time, the head portion pressing members 7 and 8 (see FIG. 7) remain unidling with respect to the support rod 6, whereby the head portion pressing member 8 also rotates along arrow Q1 with the head portion pressing member 7 (see FIG. 7). The protrusion 8*b* of the head pressing member 8 rotates along arrow Q1, whereby the head portion 2*b* having been inhibited from rotation along arrow P1 by the protrusion 8*b* rotates along arrow P1. Thus, the head portion 2*b* gradually lowers from the position upwardly separating from the platen roller 3 shown in FIG. 15 and starts moving toward the platen roller 3 (pressing side), as shown in FIG. 4.

Figure 16:
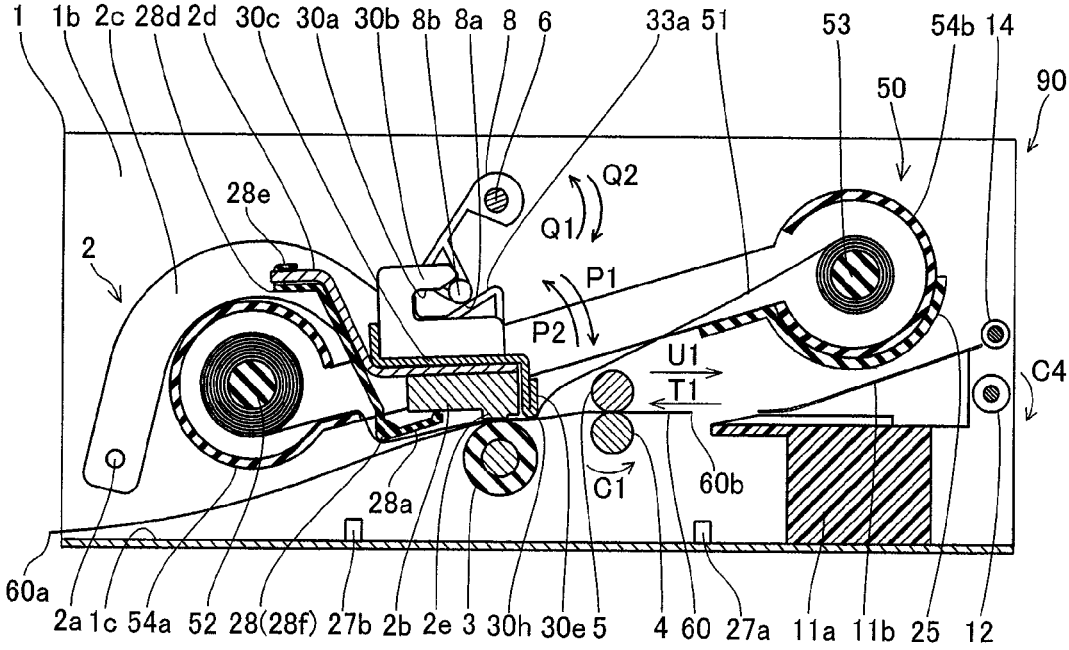

Following the rotation of the print head 2 along arrow P1, each paper 60 is transported (fed) toward a printing start position from the state shown in FIG. 15 while the paper sensors 27*a* and 27*c* for detecting the front and rear ends 60*a* and 60*b* of the paper 60 sense the paper 60, as shown in FIG. 16.

After substantially horizontally passing through the space between the print head 2 and the platen roller 3, the front end 60*a* of the paper 60 comes into contact with the lower surface of the paper guide portion 28*a* of the paper guide member 28 to be guided obliquely downward, as shown in FIG. 4. Therefore, the front end 60*a* of the paper 60 passes through the upper portion of the paper sensor 27*b* along arrow T1 without entering the supply bobbin storage portion 54*a* of the ink sheet cartridge 50.

In paper feeding, the stepping motor 18 is so driven that the motor gear 36 mounted thereon rotates along arrow C3 and the feed roller gear 10 rotates along arrow C1 through the intermediate gears 21 and 22, as shown in FIG. 5. Thus, the feed roller 4 also rotates along arrow C1. Further, the paper feed roller gear 13 and the paper feed roller 12 rotate along arrow C4 through the intermediate gears 23 and 24. Thus, the paper 60 (see FIG. 4) is transported in the paper feed direction (along arrow T1 in FIG. 4). At this time, the swingable swing gear 20 (see FIG. 5) is not in mesh with the gear 16*a* (see FIG. 5) of the take-up reel 16 (see FIG. 5), so that the gear 16*a* (see FIG. 5) of the take-up reel 16 (see FIG. 5) remains unrotating. Thus, the ink sheet 51 wound on the supply bobbin 52 (see FIG. 4) is not taken up on the take-up bobbin 53 in paper feeding.

After the paper 60 is completely sensed, the head portion pressing members 7 and 8 further rotate along arrow Q1 while the print head 2 moves to the position for pressing the ink sheet 51 and the paper 60, as shown in FIG. 16. Thus, the pressing portion 7*a* of the head portion pressing member 7 presses the first end 32*a* of the first torsion coil spring 32 mounted on the first spring fixing portion 30*i* of the engaging member 30, as shown in FIG. 7. Further, the pressing portion 8*a* of the head portion pressing member 8 presses the first end 33*a* of the second torsion coil spring 33 mounted on the second spring fixing portion 30*j* of the engaging member 30. At this time, urging force is generated on the first torsion coil springs 32 and 33 and transmitted to the upper portion of the head portion 2*b* through the second ends 32*b* and 33*b* of the first torsion coil springs 32 and 33. Thus, the print portion 2*e* of the head portion 2*b* is pressed against the platen roller 3 through the ink sheet 51 (Y ink sheet) and the paper 60, as shown in FIG. 16.

When rotating and coming into contact with the ink sheet 51 from above along arrow Y, the head portion 2*b* of the print head 2 starts coming into contact with the cross-directional end regions 51*b* (along arrow X) of the ink sheet 51 in advance of the cross-directional central region 51*a* (along arrow X) of the ink sheet 51, as shown in FIG. 10. Immediately after the ink sheet 51 is delivered from the supply bobbin 52, the ink sheet contact portion 28*f* of the paper guide member 28 pulls each cross-directional end region 51*b* (along arrow X: shown by the thick two-dot chain line) of the ink sheet 51 obliquely downward and changes the transport direction (take-up direction) for the ink sheet 51 from the oblique downward direction to the substantially horizontal direction along the surface of the ink sheet contact portion 28*f* for transporting the ink sheet 51 toward the print portion 2*e* of the print head 2, as shown in FIG. 14. At this time, the ink sheet 51 is transmitted toward the print portion 2*e* while each end region 51*b* (shown by the thick two-dot chain line) thereof is stretched with larger tensile force as compared with that for the central region 51*a* (shown by the solid line) between the printing portion 2*e* and the ink sheet contact portion 28*f*.

Then, the heating elements 29 of the print portion 2*e* so generate heat as to melt and sublimate the ink of the ink sheet 51 (Y ink sheet), thereby transferring the ink to the paper 60.

Then, the stepping motor 18 is so driven that the motor gear 36 mounted thereon rotates along arrow D3 and the feed roller gear 10 rotates along arrow D1 through the intermediate gears 21 and 22, as shown in FIG. 5. Thus, the feed roller 4 also rotates along arrow D1 in FIG. 5 following the rotation of the feed roller gear 10 (see FIG. 5) thereby transporting the paper 60 in the paper discharge direction (along arrow U1), as shown in FIG. 16. The swingable swing gear 20 swings in a direction (along arrow D2) for meshing with the gear portion 16*a* of the take-up reel 16 to mesh with the gear portion 16*a* of the take-up reel 16, as shown in FIG. 6. Thus, the gear portion 16*a* of the take-up reel 16 rotates along arrow D4, thereby taking up the ink sheet 51 wound on the supply bobbin 52 (see FIG. 16) on the take-up bobbin 53. Thus, both of the paper 60 and the ink sheet 51 are transported in the paper discharge direction (along arrow U1) while the ink is continuously transferred from the ink sheet 51 (Y ink sheet) to the paper 60, as shown in FIG. 16.

When the ink sheet 51 is transported along arrow A immediately after the ink is transferred to the paper 60, the contact portion 30*h* changes the transport direction from the substantially horizontal direction to the obliquely upward direction on the positions R1 and R2 (shown by the black circles) of the flat portion 30*f* and each inclined portion 30*g* (shown by the thin two-dot chain line) of the ink sheet guide portion 30*e* for the central region 51*a* (shown by the solid line) and each end region 51*b* (shown by the thick two-dot chain line) of the ink sheet 51 respectively, as shown in FIG. 13. Therefore, the ink sheet 51 passes through the contact portion 30*h* of the ink sheet guide portion 30*e* while warping from the central region 51*a* coming into contact with the flat portion 30*f* of the ink sheet guide portion 30*e* toward the end regions 51*b* coming into contact with the inclined portions 30*g* in the cross direction (along arrow X in FIG. 11) of the ink sheet 51, to be taken up on the take-up bobbin 53 (see FIG. 16).

Figure 17:
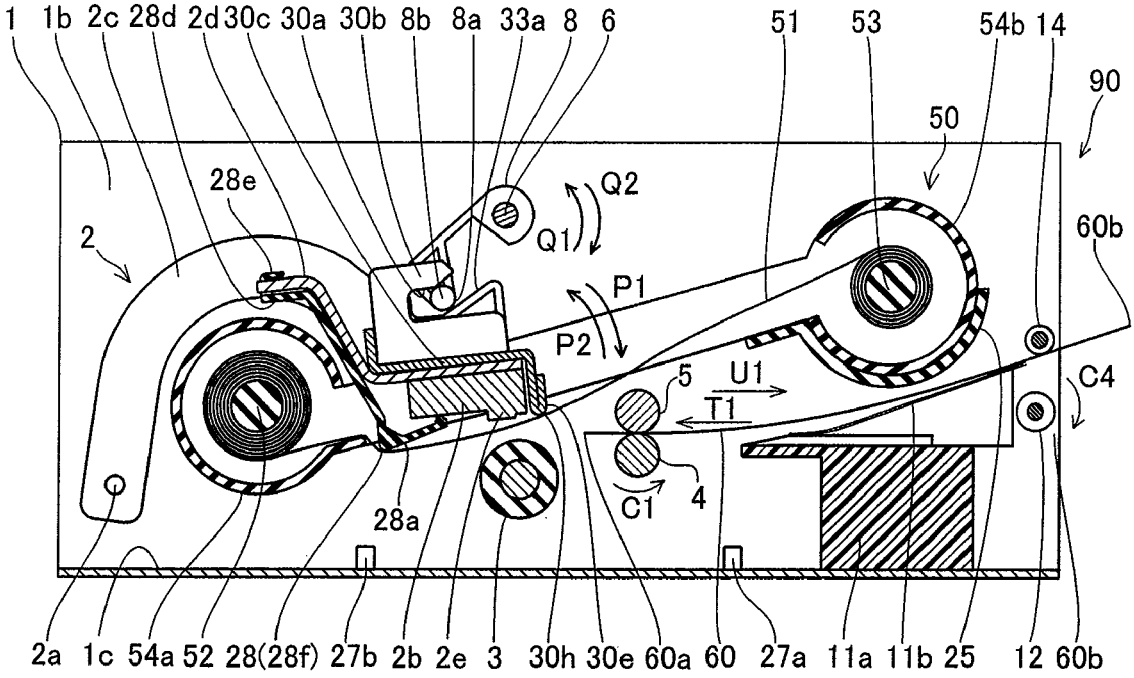

When the paper 60 is completely printed with the Y (yellow) ink sheet, the stepping motor 19 is so driven that the driving force thereof is transmitted to the gear portion 7*b* (see FIG. 1) of the head portion pressing member 7 through the intermediate gear 34 (see FIG. 7) and the driving gear 9 (see FIG. 1). Thus, the head portion pressing member 7 (see FIG. 6) rotates along arrow Q2 about the support rod 6, as shown in FIG. 17. At this time, the head portion pressing members 7 and 8 (see FIG. 6) remain unidling with respect to the support rod 6, whereby the head portion pressing member 8 also rotates along arrow Q2. Further, the protrusion 8*b* of the head pressing member 8 rotates along arrow Q2, thereby lifting up the engaging portion 30*b* (more strictly, the notch 30*a*) of the engaging member 30 of the print head 2 engaging with the protrusion 8*b* and rotating the head portion 2*b* of the print head 2 along arrow P2. Thus, the head portion 2*b* of the print head 2 moves to the position separating from the platen roller 3.

Then, the stepping motor 18 is so driven that the motor gear 36 mounted thereon rotates along arrow C3 and the feed roller gear 10 rotates along arrow C1 through the intermediate gears 21 and 22, as shown in FIG. 5. Thus, the feed roller 4 rotates along arrow C1 following the rotation of the feed roller gear 10 (see FIG. 4) as shown in FIG. 17, thereby transporting the paper 60 in the paper feed direction (along arrow T1) so that the paper sensors 27*a* and 27*b* sense the paper 60. The swingable swing gear 20 (see FIG. 5) swings in a direction (along arrow C2 in FIG. 5) for separating from the gear portion 16*a* of the take-up reel 16 (see FIG. 5). Thus, the ink sheet 51 wound on the supply bobbin 52 is not taken up on the take-up bobbin 53 but only the paper 60 is transported in the paper feed direction.

After substantially horizontally passing through the space between the print head 2 and the platen roller 3, the front end 60*a* of the paper 60 comes into contact with the lower surface of the paper guide portion 28*a* of the paper guide member 28 to be guided obliquely downward, as shown in FIG. 4. Therefore, the front end 60*a* of the paper 60 passes through the upper portion of the paper sensor 27*b* along arrow T1 without entering the supply bobbin storage portion 54*a* of the ink sheet cartridge 50.

Thereafter operations similar to the aforementioned printing operation with the Y (yellow) ink sheet shown in FIGS. 15 to 17 are repeated as to the M (magenta) and C (cyan) ink sheets.

According to this embodiment, the head portion 2*b* of the print head 2 also starts coming into contact with the cross-directional end regions 51*b* (along arrow X) of the ink sheet 51 in advance of the cross-directional central region 51*a* (along arrow X) of the ink sheet 51, as shown in FIG. 10 when the paper 60 (see FIG. 16) is printed with the M (magenta) and C (cyan) ink sheets of the ink sheet 51 (see FIG. 16) taken up on the take-up bobbin 53 (see FIG. 16). Immediately after the ink sheet 51 is delivered from the supply bobbin 52, the ink sheet contact portion 28*f* of the paper guide member 28 pulls each cross-directional end region 51*b* (along arrow X: shown by the thick two-dot chain line) of the ink sheet 51 obliquely downward and changes the transport direction (take-up direction) for the ink sheet 51 from the oblique downward direction to the substantially horizontal direction along the surface of the ink sheet contact portion 28*f* for transporting the ink sheet 51 toward the print portion 2*e* of the print head 2 as shown in FIG. 14, similarly to the case of the printing operation with the Y (yellow) ink sheet. At this time, the ink sheet 51 is transmitted while each end region 51*b* (shown by the thick two-dot chain line) thereof is stretched with larger tensile force as compared with that for the central region 51*a* (shown by the solid line) between the printing portion 2*e* and the ink sheet contact portion 28*f*.

Then, the heating elements 29 of the print portion 2*e* so generate heat as to melt and sublimate the inks of the ink sheet 51 (M and C ink sheets), thereby transferring the inks to the paper 60.

Also when the ink sheet 51 is transported along arrow A immediately after the M and C inks are transferred to the paper 60, the contact portion 30*h* changes the transport direction from the substantially horizontal direction to the obliquely upward direction on the positions R1 and R2 (shown by the black circles) of the flat portion 30*f* and each inclined portion 30*g* (shown by the thin two-dot chain line) of the ink sheet guide portion 30*e* for the central region 51*a* (shown by the solid line) and each end region 51*b* (shown by the thick two-dot chain line) of the ink sheet 51 respectively, as shown in FIG. 13. Therefore, the ink sheet 51 passes through the contact portion 30*h* of the ink sheet guide portion 30*e* while warping from the central region 51*a* coming into contact with the flat portion 30*f* of the ink sheet guide portion 30*e* toward the end regions 51*b* coming into contact with the inclined portions 30*g* in the cross direction (along arrow X in FIG. 11) of the ink sheet 51, to be taken up on the take-up bobbin 53 (see FIG. 16).

When printed with all inks of the ink sheet 51, the paper 60 is transported in the paper discharge direction (along arrow U1 in FIG. 17) and discharged from the printer body 90. Then, the head portion 2*b* of the print head 2 rotates along arrow P2 to the position upwardly separating from the platen roller 3 as shown in FIG. 15, for terminating the printing operation on the paper 60.

According to this embodiment, as hereinabove described, the sublimatic printer 100 comprises the paper guide member 28 guiding the transport direction for each paper 60 when feeding the paper 60 so that the paper guide member 28 guides the transport direction for the paper 60 even if the paper 60 is fed into the printer body 90 with unnecessary warpage, thereby properly feeding the paper 60. The sublimatic printer 100 further comprises the ink sheet guide member 30*e* having the central portion convexed toward the take-up direction (along arrow A in FIG. 11) for the ink sheet 51 with respect to the print head 2 in plan view for guiding transportation of the ink sheet 51 in printing so that the ink sheet guide member 30*e* guides transportation of the ink sheet 51 on the anteroposteriorly different positions R1 and R2 (see FIG. 13) with respect to the take-up direction (along arrow A in FIG. 13) for the ink sheet 51 on the cross-directional central region 51*a* (see FIG. 13) and the cross-directional end regions 51*b* of the ink sheet 51. In other words, transportation of the ink sheet 51 is guided successively from the cross-directional end regions 51*b* (corresponding to the position R2) toward the central region 51*a* (corresponding to the position R1) of the ink sheet 51, whereby wrinkling easily caused on the end regions 51*b* of the ink sheet 51 can be preferentially suppressed.

According to this embodiment, the ink sheet 51 can pass through the ink sheet guide portion 30*e* while obliquely upwardly warping from the central region 51*a* coming into contact with the flat portion 30*f* of the ink sheet guide portion 30*e* toward the end regions 51*b* coming into contact with the inclined regions 30*g* as shown in FIG. 13 to be tensioned not only in the take-up direction (along arrow A in FIG. 10) but also in the cross direction, whereby the overall cross-directional region of the ink sheet 51 can be prevented from wrinkling, in addition to the aforementioned effect.

According to this embodiment, the paper guide member 28 integrally includes the ink sheet contact portion 28*f* having the regions, corresponding to the cross-directional end regions 51*b* (along arrow X in FIG. 10) of the ink sheet 51, so shaped as to apply tension to the cross-directional end regions 51*b* (along arrow X in FIG. 10) of the ink sheet 51 so that the cross-directional end regions 51*b* (along arrow X in FIG. 10) of the ink sheet 51 are transported in the state stretched by the ink sheet contact portion 28*f* of the paper guide member 28, whereby wrinkling easily caused on the cross-directional end regions 51*b* (along arrow X in FIG. 10) of the ink sheet 51 can be more reliably suppressed also by the ink sheet contact portion 28*f* of the paper guide member 28, in addition to the aforementioned effect of suppressing wrinkling by the ink sheet guide portion 30*e*.

According to this embodiment, the paper guide member 28 is mounted on the print head 2 (head portion 2*b*) rotatable between a nonprinting position and a printing position for each paper 60 from the side (lower side) of the print head 2 opposite to the paper 60 for guiding the transport direction for the paper 60 when the print head 2 rotates toward the printing position so that the paper guide member 28 can rotate to the position (see FIG. 4) for guiding the paper 60 through the rotation of the print head 2 in printing, thereby reliably guiding the transport direction (along arrow T1 in FIG. 4) for the paper 60.

According to this embodiment, the ink sheet contact portion 28*f* of the paper guide member 28 is so formed that the regions corresponding to the cross-directional end regions 51*b* (along arrow X in FIG. 10) of the ink sheet 51 protrude toward the ink sheet 51 with respect to the region corresponding to the central region 51*a* (along arrow X in FIG. 10) of the ink sheet 51, whereby the ink sheet contact portion 28*f* of the paper guide member 28 can start coming into contact with the cross-directional end regions 51*b* (along arrow X in FIG. 10) of the ink sheet 51 from the cross-directional ends (along arrow X in FIG. 10) thereof and guide transportation of the ink sheet 51 continuously in contact with the cross-directional end regions 51*b* (along arrow X in FIG. 10) of the ink sheet 51. Therefore, the ink sheet 51 is reliably in contact with the ink sheet contact portion 28*f* on the cross-directional end regions 51*b* (along arrow X in FIG. 10) thereof, whereby the surface of the ink sheet 51 is stretched due to downward pressing force (along arrow Y in FIG. 10) from the ink sheet contact portion 28*f*. Consequently, wrinkling easily caused on the cross-directional end regions 51*b* (along arrow X in FIG. 10) of the ink sheet 51 can be easily suppressed.

According to this embodiment, the sublimatic printer 100 comprises the head portion pressing members 7 and 8 for pressing the upper portion of the head portion 2*b* of the print head 2 thereby pressing the print head 2 against the ink sheet 51 in printing and the engaging member 30 including the engaging portion 30*b* mounted on the upper surface of the heat radiating portion 2*d* of the print head 2 for engaging with the head portion pressing members 7 and 8 and vertically moving the print head 2 along arrows P1 and P2 (see FIG. 4) while the ink sheet guide portion 30*e* is integrally provided on the engaging member 30, whereby the pressing force of the head portion pressing members 7 and 8 pressing the upper portion of the print head 2 can be directly transmitted to the print head 2. Therefore, the oblong print head 2 having a prescribed printing width in the longitudinal direction can be reliably pressed against the ink sheet 51 with proper pressing force. Further, increase in the number of components constituting the print head 2 can be suppressed dissimilarly to a case of providing the ink sheet guide portion 30*e* independently of the engaging member 30.

According to this embodiment, the ink sheet guide portion 30*e* includes the flat portion 30*f* (the contact portion 30*h*) coming into contact with the ink sheet 51 in the direction (along arrow X in FIG. 11) substantially perpendicular to the transport direction (along arrow A in FIG. 11) for the ink sheet 51 thereby guiding the transport direction for the ink sheet 51 upon rotation of the print head 2 to the printing position so that the ink sheet guide portion 30*e* comes into contact with the ink sheet 51 along the direction substantially perpendicular to the transport direction for the ink sheet 51 due to the flat portion 30*f* (contact portion 30*h*), thereby horizontally uniformly guiding the ink sheet 51. Thus, the ink sheet 51 can be regularly transported in the direction perpendicular to the flat portion 30*f* (the contact portion 30*h*).

According to this embodiment, the length (total length of the flat portion 30*f* and the two inclined portions 30*g*) of the ink sheet guide portion 30*e* is larger than the cross-directional length (along arrow X in FIG. 11) of the ink sheet 51 so that the contact portion 30*h* (see FIG. 8) of the ink sheet guide portion 30*e* comes into contact with the overall cross-directional region of the ink sheet 51, whereby transportation of the ink sheet 51 can be more reliably guided.

According to this embodiment, the contact portion 30*h* of the ink sheet guide portion 30*e* coming into contact with the ink sheet 51 is formed by folding an end of the engaging member 30 of sheet metal substantially by 180° to be U-shaped along the transport direction (along arrow A in FIG. 12) for the ink sheet 51 so that the ink sheet guide portion 30*e* can smoothly come into contact with the ink sheet 51 on the contact portion 30*h* when the ink sheet 51 is taken up along arrow A (see FIG. 12), whereby the ink sheet 51 can be prevented from scratching caused by the ink sheet guide portion 30*e* or wrinkling resulting from friction with the contact portion 30*h*.

According to this embodiment, the engaging member 30 integrally provided with the ink sheet guide portion 30*e* further includes the fixed portion 30*c* mounted on the print head 2 and the coupling portion 30*d* coupling the fixed portion 30*c* with the central portion of the ink sheet guide portion 30*e* while the inclined portions 30*g* of the ink sheet guide portion 30*e* are provided on the cross-directional ends (along arrow X in FIG. 6) not connected with the coupling portion 30*d* of the ink sheet guide portion 30*e* so that the inclined portions 30*g* not connected with the coupling portion 30*d* of the ink sheet guide portion 30*e* can be easily bent by bending a plate member, whereby the inclined portions 30*g* of the ink sheet guide portion 30*e* can be easily formed.

According to this embodiment, the inclined portions 30*g* of the ink sheet guide portion 30*e* are inclined by the prescribed angle α with respect to the flat portion 30*f* of the ink sheet guide portion 30*e* so that the ink sheet 51 can horizontally symmetrically warp from the cross-directional central region 51*a* (along arrow X in FIG. 11) toward the cross-directional end regions 51*b* thereof, whereby the ink sheet 51 can be horizontally uniformly prevented from cross-directional wrinkling.

According to this embodiment, the sublimatic printer 100 comprises the first and second torsion coil springs 32 and 33 for transmitting the pressing force of the head portion pressing members 7 and 8 to the upper surface (upper portion) of the head portion 2*b* of the print head 2 through the engaging member 30 while the engaging member 30 is enabled to fix the first and second torsion coil springs 32 and 33 so that the engaging member 30 may not be separately provided with a member for fixing the first and second torsion coil springs 32 and 33, whereby increase in the number of components constituting the print head 2 can be suppressed.

According to this embodiment, the inclined portions 30*g* of the ink sheet guide portion 30*e* arranged between the print portion 2*e* of the print head 2 and the take-up bobbin 53 are provided on the sides of the cross-directional ends (along arrow X in FIG. 11) of the print head 2 in plan view and inclined at the constant angle α from the take-up bobbin 53 toward the print portion 2*e* of the print head 2 so that the inclined portions 30*g* of the ink sheet guide portion 30*e* guide the cross-directional end regions 51*b* (along arrow X in FIG. 6) of the ink sheet 51 from positions closer to the print portion 2*e* of the print head 2 with respect to the transport direction (along arrow A in FIG. 11) for the ink sheet 51, whereby the print head 2 can more reliably press the ink sheet 51 prevented from wrinkling.

According to this embodiment, the ink sheet guide portion 30*e* can continuously warp the ink sheet 51 from the central region 51*a* toward the end regions 51*b* along the cross direction (along arrow X in FIG. 6) of the ink sheet 51 in the direction (opposite to the transport direction for the ink sheet 51) from the ink sheet guide portion 30*e* toward the print portion 2*e* along the inclined portions 30*g* as shown in FIG. 13, whereby the print head 2 can more reliably press the ink sheet 51 prevented from wrinkling, in addition to the aforementioned effects.

According to this embodiment, the inclined portions 30*g* of the ink sheet guide portion 30*e* are provided on the positions corresponding to portions close to the cross-directional end regions 51*b* of the ink sheet 51 for guiding transportation of the ink sheet 51 on the cross-directional end regions 51*b* (along arrow X in FIG. 6) of the ink sheet 51, whereby the inclined portions 30*g* of the ink sheet guide portion 30*e* can easily prevent the cross-directional end regions 51*b* of the ink sheet 51 from wrinkling. In particular, the inclined portions 30*g* of the ink sheet guide portion 30*e* can warp the end regions 51*b* of the ink sheet 51 in the cross direction (along arrow X in FIG. 6) of the ink sheet 51 as shown in FIG. 13, whereby the end regions 51*b* of the ink sheet 51 can be more reliably inhibited from wrinkling.

According to this embodiment, the ink sheet 51 is stored in the ink sheet cartridge 50 and transported from the supply bobbin 52 of the ink sheet cartridge 50 toward the take-up bobbin 53 in printing while the paper guide member 28 integrally including the ink sheet contact portion 28*f* is arranged between the print portion 2*e* of the print head 2 and the supply bobbin 52 so that the ink sheet 51 is transported along arrow A see FIG. 14) without wrinkling the cross-directional end regions 51*b* (along arrow X in FIG. 10) of the ink sheet 51 on the section held between the print head 2 and the paper guide member 28 in printing, whereby the print portion 2*e* of the print head 2 can reliably press the ink sheet 51 prevented from wrinkling.

According to this embodiment, the ink sheet contact portion 28*f* of the paper guide member 28 is formed by the inclined surface 28*g* curvedly inclined from the cross-directional central portion (along arrow X in FIG. 10) toward the ends of the paper guide member 28 so that the ink sheet contact portion 28*f* can come into contact with the ink sheet 51 from the cross-directional ends (along arrow X in FIG. 10) toward the central portion through the smooth inclined surface 28*g*, whereby the transported ink sheet 51 can be prevented from scratches or the like resulting from the shape of the ink sheet contact portion 28*f*.

According to this embodiment, the length of the ink sheet contact portion 28*f* of the paper guide member 28 is larger than the cross-directional length (along arrow X in FIG. 10) of the ink sheet 51, whereby the transported ink sheet 51 can be more reliably prevented from scratches or the like dissimilarly to a case where the cross-directional ends of the ink sheet contact portion 28*f* come into contact with the ink sheet 51 to cause unnecessary wrinkles or scratches.

According to this embodiment, the paper guide member 28 is made of resin while the surface (corresponding to the inclined surface 28*g*) of the ink sheet contact portion 28*f* of the paper guide member 28 is rounded along the transport direction for the ink sheet 51 to be smoothly contactable with the ink sheet 51 also in the transport direction (along arrow A in FIG. 14) when the ink sheet 51 is taken up in printing, whereby the ink sheet 51 can be prevented from scratches resulting from the ink sheet contact portion 28*f* and wrinkling resulting from friction.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the sublimatic printer 100 employed as an exemplary image generating apparatus, the present invention is not restricted to this but is also applicable to another image generating apparatus other than the sublimatic printer, so far as the same comprises a print head, including a print portion coming into contact with an ink sheet, capable of printing images on papers.

While the ink sheet contact portion 28*f* is formed by the inclined surface 28*g* so bent that the cross-directional ends protrude beyond the cross-directional central portion with respect to the ink sheet 51 in the aforementioned embodiment, the present invention is not restricted to this but the ink sheet guide portion 30*e* may alternatively be provided with a flat portion, having a prescribed distance, parallel to the ink sheet 51 on the cross-directional central portion thereof and connected with an inclined surface inclined from both ends of the flat portion toward the ends of the ink sheet contact portion 28*f* at a prescribed angle.

While the ink sheet guide portion 30*e* is provided with the inclined portions 30*g* inclined at the constant angle $\alpha$ on both ends of the flat portion 30*f* in the aforementioned embodiment, the present invention is not restricted to this but inclined portions having not a constant inclined angle but bent inclined surfaces, for example, may alternatively be formed on both ends of the flat portion 30*f*.

While the paper guide member 28 is made of resin in the aforementioned embodiment, the present invention is not restricted to this but the paper guide member 28 may alternatively be made of sheet metal and the ink sheet contact portion 28*f* may alternatively be formed by bending a plate member, similarly to the case of forming the flat portion 30*f* and the inclined portion 30*g* on the ink sheet guide portion 30*e* of the engaging member 30 by sheet metal working.

While the engaging member 30 is made of sheet metal in the aforementioned embodiment, the present invention is not restricted to this but the engaging member 30 may alternatively be constituted of an integrally molded component formed by a resin member.

While the first and second torsion coil springs 32 and 33 transmit the pressing force of the head portion pressing members 7 and 8 to the upper portion of the print head 2 through the engaging member 30 in the aforementioned embodiment, the present invention is not restricted to this but spring members other than torsion coil springs may alternatively transmit the pressing force of the head portion pressing members 7 and 8 to the upper portion of the print head 2.

What is claimed is:

1. An image generating apparatus comprising:

a print head, including a print portion pressing an ink sheet, capable of printing an image on a paper;

a paper guide member guiding a transport direction for said paper when feeding said paper; and an ink sheet guide member, having a central portion convexed toward a take-up direction for said ink sheet with respect to said print head in plan view, for guiding transportation of said ink sheet in printing, wherein a region of said paper guide member corresponding to an end portion in a direction perpendicular to said take-up direction for said ink sheet includes an ink sheet contact portion having a concave shape so as to apply tension to said end portion in the direction perpendicular to said take-up direction for said ink sheet and a rib for supporting the lower surface of said print head.

2. The image generating apparatus according to claim 1, wherein said paper guide member is so formed as to rotate with said print head rotatable between a nonprinting position and a printing position for said paper, and said paper guide member is so formed as to guide said transport direction for said paper when said print head rotates to said printing position.

3. The image generating apparatus according to claim 1, wherein said ink sheet contact portion of said paper guide member is so formed that a region corresponding to said cross-directional end of said ink sheet protrudes toward said ink sheet with respect to another region corresponding to a cross-directional central portion of said ink sheet.

4. The image generating apparatus according to claim 1, further comprising:

ahead portion pressing member for pressing said print head against said ink sheet by pressing the upper portion of said print head with prescribed pressing force in printing, and an engaging member, mounted on said print head, including an engaging portion for engaging with said head portion pressing member and vertically moving said print head; wherein said ink sheet guide member is provided on said engaging member.

5. The image generating apparatus according to claim 4, wherein said print head is rotatable between a nonprinting position and a printing position for said paper, and said ink sheet guide member includes a contact portion guiding a transport direction for said ink sheet by coming into contact with said ink sheet along a direction substantially perpendicular to said transport direction for said ink sheet when said print head rotates to said printing position.

6. The image generating apparatus according to claim 5, wherein the length of said contact portion of said ink sheet guide member is larger than the cross-directional length of said ink sheet.

7. The image generating apparatus according to claim 5, wherein said engaging member provided with said ink sheet guide member is made of sheet metal, and said contact portion of said ink sheet guide member coming into contact with said ink sheet is formed in a U-shaped manner along said transport direction for said ink sheet by folding an end of said engaging member made of sheet metal.

8. The image generating apparatus according to claim 4, wherein said ink sheet guide member has an inclined portion, said engaging member provided with said ink sheet guide member further includes a fixed portion mounted on said, print head and a coupling portion connecting said fixed portion and said central portion of said ink sheet guide member with each other, and said inclined portion of said ink sheet guide member is provided on a cross-directional end of said ink sheet guide member not connected with said coupling portion.

9. The image generating apparatus according to claim 4, further comprising a spring member for transmitting said pressing force of said head portion pressing member to said print head through said engaging member, wherein said engaging member is enabled to fix said spring member.

10. The image generating apparatus according to claim 1, wherein said ink sheet guide member has an inclined portion, said ink sheet is stored in an ink sheet cartridge and taken up on a take-up bobbin of said ink sheet cartridge, said ink sheet guide member is arranged between said print portion of said print head and said take-up bobbin, and said inclined portion of said ink sheet guide member is provided on a cross-directional end of said print head in plan view, to be inclined from the side closer to said take-up bobbin toward said print head.

11. The image generating apparatus according to claim 1, wherein said ink sheet guide member has an inclined portion, and said inclined portion of said ink sheet guide member is provided on a position corresponding to a portion close to said cross-directional end of said ink sheet.

12. The image generating apparatus according to claim 1, wherein said ink sheet is stored in an ink sheet cartridge and transported from a supply bobbin of said ink sheet cartridge toward a take-up bobbin in printing, and said paper guide member including said ink sheet contact portion is arranged between said print portion of said print head and said supply bobbin.

13. The image generating apparatus according to claim 3, wherein said ink sheet contact portion of said paper guide member is formed by an inclined surface curvedly inclined from said cross-directional central portion toward an end of said paper guide member.

14. The image generating apparatus according to claim 13, wherein the length of said ink sheet contact portion of said paper guide member is larger than the cross-directional length of said ink sheet.

15. The image generating apparatus according to claim 1, wherein said paper guide member is made of resin, and the surface of said ink sheet contact portion of said paper guide member is rounded along said transport direction for said ink sheet.

* * * * *